US006664977B1

(12) United States Patent
Masumoto

(10) Patent No.: US 6,664,977 B1
(45) Date of Patent: Dec. 16, 2003

(54) VIDEO SIGNAL PROCESSING DEVICE THAT ALLOWS AN IMAGE DISPLAY DEVICE ON WHICH PIXELS ARE FIXED IN NUMBER TO DISPLAY EVERY VIDEO SIGNAL

(75) Inventor: Junji Masumoto, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/673,417

(22) PCT Filed: Feb. 17, 2000

(86) PCT No.: PCT/JP00/00882

§ 371 (c)(1),
(2), (4) Date: Oct. 18, 2000

(87) PCT Pub. No.: WO00/49595

PCT Pub. Date: Aug. 24, 2000

(30) Foreign Application Priority Data

Feb. 19, 1999 (JP) ..... 11-041191

(51) Int. Cl.[7] ..... G09G 5/10

(52) U.S. Cl. ..... 345/698; 345/699; 345/213; 348/556

(58) Field of Search ..... 345/204–214, 345/698, 699; 348/552–556, 387.1, 389.1; 380/206, 207, 210, 212

(56) References Cited

U.S. PATENT DOCUMENTS 5,402,488 A * 3/1995 Karlock ..... 380/204
6,108,043 A * 8/2000 White ..... 348/531
6,148,320 A * 11/2000 Katznelson ..... 380/206
6,256,003 B1 * 7/2001 Tsuchiya et al. ..... 345/87
6,330,034 B1 * 12/2001 Renner et al. ..... 348/536

FOREIGN PATENT DOCUMENTS

JP 10-260663 9/1998

* cited by examiner

*Primary Examiner*—Amr Awad
(74) *Attorney, Agent, or Firm*—Wenderoth, Lind & Ponack, L.L.P.

(57) ABSTRACT

A display, on which pixels are fixed in number for display, is able to display every video signal with a simple circuit structure. A one-clock delay circuit delays a reference signal by one clock for output. A multiplexer switches between the one-clock-delayed signal and the reference signal for output. An A/D converter subjects a video signal to two-phase processing with reference to an output signal from the multiplexer. A comparator outputs a control signal to the multiplexer to let the multiplexer select the one-clock delayed signal when determining, based on a result obtained by detection in the first and second back porch detection circuits and, that a head of video data is not included in first phase output data.

13 Claims, 19 Drawing Sheets

VIDEO SIGNAL PROCESSING DEVICE THAT ALLOWS AN IMAGE DISPLAY DEVICE ON WHICH PIXELS ARE FIXED IN NUMBER TO DISPLAY EVERY VIDEO SIGNAL

TECHNICAL FIELD

The present invention relates to a video signal processing device in an image display device (e.g., a crystal liquid display, or a plasma display) on which pixels are fixed in number for display and, more specifically, to a video signal processing device subjecting a video signal inputted into the image display device to A/D conversion with two-phase processing.

BACKGROUND ART

In recent years, with the advancement in resolution of a computer as an image signal source, a clock frequency for an image display device has been becoming increasingly faster. In order for the image display device to deal with the faster clock frequency, a digital signal processing device where an incoming A/D-converted video signal is processed is required to operate according to the faster clock. This brings about problems such as higher power consumption in the image display device, and an increase in cost, for example.

To get around such problems, a conventional image display device lowers the clock frequency to half by carrying out two-phase processing in an A/D converter. Thereby, the digital signal processing device provided in a stage subsequent to the A/D converter has no need to operate in accordance with the faster clock. Herein, the processing carried out in the A/D converter may be four-phase or six-phase, and is similarly effective to the two-phase processing.

Herein, as to the A/D converter carrying out the two-phase processing, various types of products are available. For example, these include a CXA3026AQ model (manufactured by SONY), and an AD9054BST model (manufactured by AnalogDevices).

FIG. 17 is a block diagram showing the structure of the conventional video signal processing device carrying out the two-phase processing in the A/D converter. In FIG. 17, the video signal processing device is an A/D converter 3 receiving a reference signal 9 and a video signal 24 from an image signal source, carrying out the two-phase processing, and outputting first phase data 10 and second phase data 11. Described next below is the operation of such video signal processing device with reference to FIGS. 17 and 18.

FIG. 18 is a diagram for explaining the operation of the A/D converter 3 in FIG. 17. In FIG. 18, a to e denote video data included in the video signal 24 in a valid video period. Blackened objects in the shape of a circle, diamond, square, and triangle denote data in the pedestal level, specifically black data, in a back porch. Moreover, t1 to t10 each indicate a certain time. Arrows therein schematically show the two-phase processing in the A/D converter 3.

In FIG. 18, the video signal 24 includes the back porch and the video data. The back porch is between time t1 (or before) and time t5, while the video signal data is included from time t5 and onward. Accordingly, the video signal 24 has such structure that a leading edge of a signal including the video data follows an end of the back porch.

Herein, with reference to a pulse of the reference signal 9 provided to the A/D converter 3, the digital data both outputted from the A/D converter 3 is determined based on a phase relationship between the digital data and the video signal 24. Generally, the reference signal 9 is a horizontal synchronizing signal provided from the image signal source.

First, as to the first phase data 10, with reference to the pulse of the reference signal 9, the A/D converter 3 starts the two-phase processing at time t1. As shown in FIG. 18, at time t3, the black data denoted by the blackened circle is outputted from the A/D Converter 3 as the first phase data 10. At the same time, the black data denoted by the diamond is outputted from the A/D converter 3 as the second phase data 11. Thereafter, similarly at time t5, the black data each denoted by the square and the triangle is outputted.

Accordingly, in the video signal 24, when the number of data in the back porch, that is from a leading edge of the pulse of the reference signal 9 to immediately before head data a, is even, the head data a is outputted from the A/D converter 3 as the first phase data 10. On the other hand, when the number of data in the back porch is odd, the head data a is outputted from the A/D converter 3 as the second phase data 11.

The problem herein is, if such conventional structure is applied, a display, e.g., a crystal liquid display or a plasma display, on which pixels are fixed in number for display, may be one dot short when displaying the video data. Next, such a problem is described below by referring to FIGS. 19 through 20(*b*).

FIG. 19 is a schematic diagram for explaining the arrangement of output data and display status on the display for a case where the video data a shown in FIG. 18 is outputted from the A/D converter as the first phase data. FIG. 20(*a*) is a schematic diagram for explaining the arrangement of output data and display status on the display for a case where the video data a shown in FIG. 18 is outputted from the A/D converter as the second phase data. FIG. 20(*b*) is a schematic diagram for explaining a case where the data arrangement is the same as in FIG. 20(*a*), but the display status is different therefrom.

In FIGS. 19 through 20(*b*), a to t denote data included in a video signal, from an image signal source, observed on an arbitrary scan line in a valid video period. Herein, the data inside of a frame in the shape of a square is displayed on the display, while the data outside of the frame is not displayed on the display.

As shown in FIG. 19, when the head data (data displayed on the left end on the display) a of the video signal is included in the first phase data 10 outputted from the A/D converter, the display where pixels displayed thereon are fixed in number displays every video data from a to t. On the other hand, as shown in FIGS. 20(*a*) and (*b*), when the head data a is included in the second phase data 11, either the video data t on the right end or the video data a on the left end is problematically not displayed on the display. This is because the digital signal processing device in the stage subsequent to the A/D converter 3 carries out processing in a frequency half of a dot clock coming from the image signal source, causing a video phase on the display to change only in pairs of pixels.

As is known from the above, with the conventional video signal processing device, when the head data a is included in the second phase data 11, the video data is displayed in a state of one dot short as shown in FIG. 20(*a*) or (*b*). Consequently, as shown in FIG. 19, the video data a to t cannot be simultaneously displayed.

Therefore, an object of the present invention is to provide a video signal processing device capable of, even with an A/D converter carrying out the two-phase processing, displaying every pixel on a display even if a head of video data is not in the first phase output data.

SUMMARY OF THE INVENTION

A first aspect of the present invention is directed to a video signal processing device for displaying, on a display, every pixel in a video signal inputted from an image signal source, the device comprising:

a clock delay circuit for receiving a reference signal, and delaying the reference signal by an odd number of clocks for output;

a multiplexer for selecting either the reference signal or an output signal from the clock delay circuit for output;

an A/D converter for converting the video signal into a digital signal for two-phase output as first phase data and second phase data with reference to an output signal from the multiplexer;

a first leading edge detection circuit for detecting a leading edge of a valid video signal region in the first phase data, and outputting a detection signal corresponding thereto;

a second leading edge detection circuit for detecting a leading edge of a valid video signal region in the second phase data, and outputting a detection signal corresponding thereto;

a first back porch detection circuit for detecting a first back porch period starting from the output signal from the multiplexer to the detection signal outputted from the first leading edge detection circuit;

a second back porch detection circuit for detecting a second back porch period starting from the output signal from the multiplexer to the detection signal outputted from the second leading edge detection circuit; and a comparator for comparing the first back porch period and the second back porch period, and when the first back porch period is longer than the second back porch period, determining that head data in the valid video signal region in the video signal is not included in the first phase data, and outputting a signal for controlling the multiplexer to switch an output signal therefrom.

As described above, in the first aspect of the present invention, even if a head of video data is not included in first phase data under normal circumstances, a display can display every pixel by using a signal delayed by one clock phase.

According to a second aspect of the present invention, in the first aspect of the present invention, the first back porch detection circuit detects the first back porch period by using the number of clocks in the video signal, and the second back porch detection circuit detects the second back porch period by using the number of clocks in the video signal.

As described above, in the second aspect of the present invention, correct counting can be achieved by using the number of dot clocks coming from an image signal source.

According to a third aspect of the present invention, in the first aspect of the present invention, further comprising a first minimum value retention circuit for inputting, into the comparator, a minimum value of the first back porch periods outputted from the first back porch detection circuit as another first back porch period, and a second minimum value retention circuit for inputting, into the comparator, a minimum value of the second back porch period outputted from the second back porch detection circuit as another second back porch period.

As described above, in the third aspect of the present invention, it is possible to deal with a case where a video signal from an image signal source is such a moving image that its back porch period does not stay the same. Therefore, a display can assuredly display every video signal.

A fourth aspect of the present invention is directed to a video signal processing device for displaying, on a display, every pixel in a video signal inputted from an image signal source, the device comprising:

a clock delay circuit for receiving a reference signal, and delaying the reference signal by an odd number of clocks for output;

a multiplexer for selecting either the reference signal or an output signal from the clock delay circuit for output;

an A/D converter for converting the video signal into a digital signal for two-phase output as first phase data and second phase data with reference to an output signal from the multiplexer;

a leading edge detection circuit for detecting, in a predetermined manner, a leading edge of a valid video signal region in either predetermined the first phase data or the second phase data, and outputting a detection signal corresponding thereto;

a back porch detection circuit for detecting a back porch period starting from the output signal from the multiplexer to the detection signal outputted from the leading edge detection circuit;

a storage part for receiving the back porch period, and storing and outputting in a manner each corresponding to the reference signal selected and outputted by the multiplexer and the output signal from the clock delay circuit; and a comparator for outputting a control signal for controlling the multiplexer to switch a signal selected and outputted therefrom so that the storage part outputs a back porch period each corresponding to the signal selected and outputted from the multiplexer, comparing the corresponding back porch periods outputted from the storage part with each other, and when the back porch period corresponding to the reference signal is equal to or shorter than the back porch period corresponding to the output signal from the clock delay circuit, determining that head data in the valid video signal region in the video signal is included in the first phase data, and outputting the control signal again.

As described above, in the fourth aspect of the present invention, a display can assuredly display every video signal with such structure that a back porch period is stored and outputted in a manner corresponding to each state, and based on data outputted thereby, a comparator carries out its determination operation.

Also, in the fourth aspect of the present invention, a detection signal used therein is either first phase data or second phase data outputted from the A/D converter. Therefore, without using both data as the detection signal, the video signal processing device can be reduced in area for wiring on a substrate, for example.

According to a fifth aspect of the present invention, in the fourth aspect of the present invention, the back porch detection circuit detects the back porch period by using the number of clocks in the video signal.

As described above, in the fifth aspect of the present invention, correct counting can be achieved by using the number of dot clocks coming from an image signal source.

A sixth aspect of the present invention is directed to a video signal processing device for displaying, on a display, every pixel in a video signal inputted from an image signal source, the device comprising:

a clock delay circuit for receiving a reference signal, and delaying the reference signal by an odd number of clocks for output;

a multiplexer for selecting either the reference signal or an output signal from the clock delay circuit for output;

an A/D converter for converting the video signal into a digital signal for two-phase output as first phase data and second phase data with reference to an output signal from the multiplexer;

a leading edge detection circuit for detecting a leading edge of a valid video signal region in the first phase data, and outputting a detection signal corresponding thereto;

a falling edge detection circuit for detecting a falling edge of a valid video signal region in the second phase data, and outputting a detection signal corresponding thereto;

a valid video period detection circuit for detecting a valid video period starting from the detection signal outputted from the leading edge detection circuit to the detection signal outputted from the falling edge detection circuit; and a comparator for comparing a value half of an inputted horizontal resolution with the valid video period, and when the value half of the horizontal resolution is larger than the valid video period in value, determining that head data in the valid video signal region in the video signal is not included in the first phase data, and outputting a signal for controlling the multiplexer to switch an output signal therefrom.

As described above, in the sixth aspect of the present invention, a display can assuredly display every video signal with such structure that a comparator receives the number of pixels detected by a valid video period detection circuit where receiving a detection pulse detected by each of a leading edge detection circuit and a falling edge detection circuit, and a value half of horizontal resolution from an image signal source connected to the present video signal processing device, and then carries out its determination operation.

According to a seventh aspect of the present invention, in the sixth aspect of the present invention, the valid video period detection circuit detects the valid video period by using the number of clocks in the video signal.

As described above, in the seventh aspect of the present invention, correct counting can be achieved by using the number of dot clocks coming from an image signal source.

An eighth aspect of the present invention is directed to a video signal processing device for displaying, on a display, every pixel in a video signal inputted from an image signal source, the device comprising:

a clock delay circuit for receiving a reference signal, and delaying the reference signal by an odd number of clocks for output;

a multiplexer for selecting either the reference signal or an output signal from the clock delay circuit for output;

an A/D converter for converting the video signal into a digital signal for two-phase output as first phase data and second phase data with reference to an output signal from the multiplexer;

a leading edge detection circuit for detecting a leading edge of a valid video signal region in the second phase data, and outputting a detection signal corresponding thereto;

a falling edge detection circuit for detecting a falling edge of the valid video signal region in the first phase data, and outputting a detection signal corresponding thereto;

a valid video period detection circuit for detecting a valid video period starting from the detection signal outputted from the leading edge detection circuit to the detection signal outputted from the falling edge detection circuit; and a comparator for comparing a value half of an inputted horizontal resolution with the valid video period, and when the value half of the horizontal resolution is smaller than the valid video period in value, determining that head data in the valid video signal region in the, video signal is not included in the first phase data, and outputting a signal for controlling the multiplexer to switch an output signal therefrom.

As described above, in the eighth aspect of the present invention, no matter what the data included in a video signal is ON or OFF, a display can assuredly display every video signal with such structure that a comparator receives the number of pixels detected by a valid video period detection circuit where receiving a detection pulse detected by each of a leading edge detection circuit and a falling edge detection circuit, and a value half of horizontal resolution from an image signal source connected to the present video signal processing device, and then carries out its determination operation.

According to a ninth aspect of the present invention, in the eighth aspect of the present invention, the valid video period detection circuit detects the valid video period by using the number of clocks in the video signal.

As described above, in the ninth aspect of the present invention, correct counting can be achieved by using the number of dot clocks coming from an image signal source.

A tenth aspect of the present invention is directed to a video signal processing device for displaying, on a display, every pixel in a video signal inputted from an image signal source, the device comprising:

a clock delay circuit for receiving a reference signal, and delaying the reference signal by the odd number of clocks for output;

a multiplexer for selecting either the reference signal or an output signal from the clock delay circuit for output;

an A/D converter for converting the video signal into a digital signal for two-phase output as first phase data and second phase data with reference to an output signal from the multiplexer;

a first leading edge detection circuit for detecting a leading edge of a valid video signal region in the first phase data, and outputting a detection signal corresponding thereto;

a second leading edge detection circuit for detecting a leading edge of a valid video signal region in the second phase data, and outputting a detection signal corresponding thereto;

a first falling edge detection circuit for detecting a falling edge of the valid video signal region in the second phase data, and outputting a detection signal corresponding thereto;

a second falling edge detection signal for detecting a falling edge of the valid video signal region in the first phase data, and outputs a detection signal corresponding thereto;

a first valid video period detection circuit for detecting a first valid video period starting from the detection signal outputted from the first leading edge detection circuit to the detection signal outputted from the first falling edge detection circuit;

a second valid video period detection circuit for detecting a second valid video period starting from the detection signal outputted from the second leading edge detection circuit to the detection signal outputted from the second falling edge detection circuit; and a comparator for comparing the first valid video period and the second valid video period, and when the second valid video period is longer than the first valid video period, determining that head data in the valid video signal region in the video signal is not included in the first phase data, and outputting a signal for controlling the multiplexer to switch an output signal therefrom.

As described above, in the tenth aspect of the present invention, a display can assuredly display every video signal with such structure that a valid video period is detected but not a horizontal resolution.

According to an eleventh aspect of the present invention, in the tenth aspect of the present invention, the first valid video period detection circuit detects the first valid video period by using the number of clocks in the video signal, and the second valid video period detection circuit detects the second valid video period by using the number of clocks in the video signal.

As described above, in the eleventh aspect of the present invention, correct counting can be achieved by using the number of dot clocks coming from an image signal source.

A twelfth aspect of the present invention is directed to a video signal processing device for displaying, on a display, every pixel in a video signal inputted from an image signal source, the device comprising:

an A/D converter for converting the video signal into a digital signal for two-phase output as first phase data and second phase data with reference to an incoming reference signal;

a clock delay circuit for receiving the second phase data, and delaying the second phase data by the odd number of clocks for output;

a first multiplexer for selecting either the first phase data or an output signal from the clock delay circuit for output;

a second multiplexer for selecting either the second phase data or the first phase data for output;

a first leading edge detection circuit for detecting a leading edge of a valid video signal region in the first phase data, and outputting a detection signal corresponding thereto;

a second leading edge detection circuit for detecting a leading edge of a valid video signal region in the second phase data, and outputting a detection signal corresponding thereto;

a first back porch detection circuit for detecting a first back porch period starting from the reference signal to the detection signal outputted from the first leading edge detection circuit;

a second back porch detection circuit for detecting a second back porch period starting from the reference signal to the detection signal outputted from the second leading edge detection circuit; and a comparator for comparing the first back porch period and the second back porch period, and when the first back porch period is longer than the second back porch period, determining that head data in the valid video signal region in the video signal is not included in the first phase data, and outputting a signal for controlling the first and second multiplexers to switch an output signal each therefrom simultaneously, wherein right after activation, the first multiplexer selects the first phase data for output, and the second multiplexer selects the second phase data for output.

As described above, in the twelfth aspect of the present invention, it is possible to deal with an image signal source having higher resolution, and thus a display can assuredly display every video signal.

According to a thirteenth aspect of the present invention, in the twelfth aspect of the present invention, the first back porch detection circuit detects the first back porch period by using the number of clocks in the video signal, and the second back porch detection circuit detects the second back porch period by using the number of clocks in the video signal.

As described above, in the thirteenth aspect of the present invention, correct counting can be achieved by using the number of dot clocks coming from an image signal source.

BEST MODE FOR CARRYING OUT THE INVENTION

First Embodiment

Figure 1:
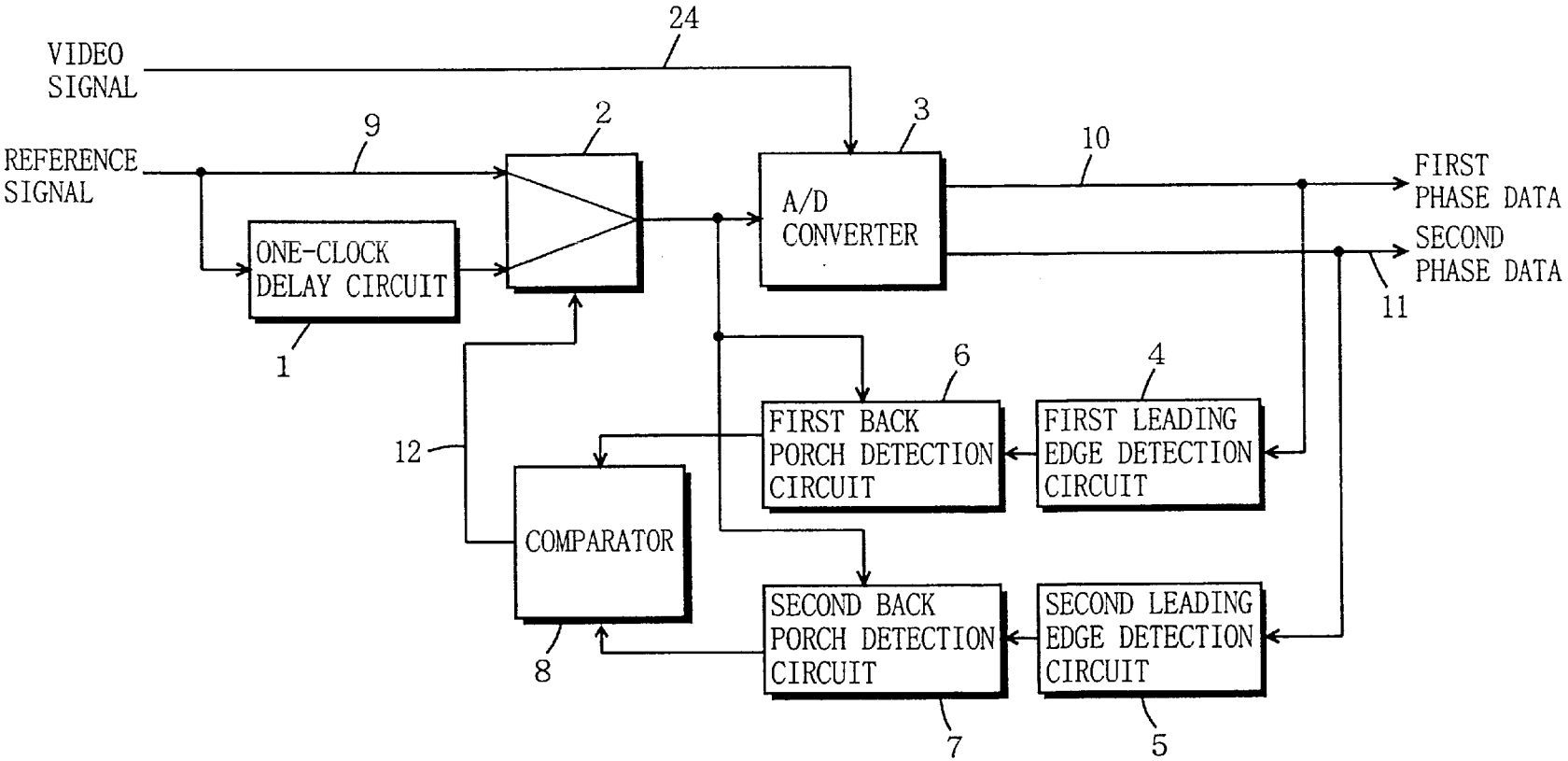
FIG. 1 is a block diagram showing the structure of a video signal processing device according to a first embodiment of the present invention.

FIG. 1 is a block diagram showing the structure of a video signal processing device according to a first embodiment of the present invention. In FIG. 1, the present video signal processing device includes a one-clock delay circuit 1 for receiving a reference signal 9 and outputting a one-clock-delayed signal, a multiplexer 2 for receiving the output signal from the one-clock delay circuit 1 and the reference signal 9, an A/D converter 3 for receiving an output signal from the multiplexer 2 and a video signal 24 and carrying out two-phase processing, first and second leading edge detection circuits 4 and 5 for detecting leading edges of an output signals from the A/D converter 3, first and second back porch detection circuits 6 and 7 for receiving signals from each corresponding first and second leading edge detection circuits 4 and 5 and the output signal from the multiplexer 2, and a comparator 8 for receiving signals from each of the first and second leading edge detection circuits 6 and 7 and outputting a control signal 12 for the multiplexer 2. Described below is the operation of a such structured video signal processing device.

In FIG. 1, the reference signal 9 provided from an image signal source connected to the present video signal processing device is applied to both the multiplexer 2 and the one-clock delay circuit 1. The reference signal 9 is generally a horizontal synchronizing signal from the image signal source, but is not necessarily restricted thereto.

The one-clock delay circuit 1 delays the received reference signal 9 by one clock for output to the multiplexer 2. To be specific, the one-clock delay circuit 1 delays the reference signal 9 by one dot clock, i.e., one pixel, out of those from the image signal source.

The multiplexer 2 selects either the received reference signal 9 or an output signal from the one-clock delay circuit 1 for output. Herein, once the control signal 12 was applied from the comparator 8, the multiplexer 2 switches from one received signal which has been selected to the other for output. It is now assumed that the multiplexer 2 has been selecting, for output, the received reference signal 9 and not the output signal from the one-clock delay circuit 1. Thereafter, once the control signal 12 was provided from the comparator 8, the multiplexer 2, in its switching operation, stops outputting the reference signal 9 which had been selected, and starts outputting the output signal from the one-clock delay circuit 1. Herein, right after the present video signal processing device is activated, the multiplexer 2 presumably selects the reference signal 9 for output. The output signal from the multiplexer 2 is applied to the A/D converter 3.

The A/D converter 3 goes through the two-phase processing after receiving the video signal 24 and the output signal from the multiplexer 2. In detail, with reference to the signal outputted from the multiplexer 2, the A/D converter 3 subjects the video signal 24 to A/D conversion, and then carries out the two-phase conversion so as to simultaneously output the first phase data 10 and the second phase data 11. These digital data are provided to a digital data processing device (not shown) provided in a stage subsequent to the A/D converter 3 for signal processing, and then displayed on a display.

The digital data outputted from the A/D converter 3, that is, the first phase data 10 and the second phase data 11 is provided to the first and second leading edge detection circuits 4 and 5, respectively. As for the received first phase data 10 and the second phase data 11, the first and second leading edge detection circuits 4 and 5 each detect a leading edge of a valid video signal region in the video signal 24 which has been applied to the A/D converter 3. For such positional detection of the leading edge of the valid video signal region, utilized is a blanking period coming from a general image signal source being black from the reference signal 9 to the valid video region. That is, the leading edge of the valid video signal region can be easily detected by detecting a period starting from the reference signal 9 until the video signal rises.

Herein, when the head data in the valid video signal region is in the pedestal level, the leading edge of the valid video signal region cannot be detected with correctness. In such a case, however, the head data in the valid video signal region is always one or more pixels short. Therefore, no such problem occurs that the display where pixels displayed thereon are fixed in number cannot display every data provided from the image signal source connected to the present video signal processing device.

With the leading edge thus detected, the first and second leading edge detection circuits 4 and 5 input the leading edge in a form of a pulse signal to the first and second back porch detection circuits 6 and 7, respectively. The first and second back porch detection circuits 6 and 7 then detect a back porch period between the signal outputted from the multiplexer 2 and the leading edge of the valid video signal region detected by the first and second leading edge detection circuits 4 and 5, respectively. Typically, the first and second leading edge detection circuits 4 and 5 each include a counter circuit, and count the back porch period by referring to the number of dot clocks from the image signal source. As such, the number of dot clocks from the image signal source helps the first and second leading edge detection circuits 4 and 5 count in a correct manner.

As described in the foregoing, when the head data in the valid video signal region is in the pedestal level, the leading edge of the valid video signal region each detected by the first and second leading edge detection circuits 4 and 5 does not always coincide with the actual leading edge of the valid video signal region. The back porch period is thus defined as a period starting from a leading edge of a signal outputted from the multiplexer 2 to a head position of data in a valid video signal region excepting data in the black level.

The back porch periods detected by the first and second back porch detection circuits 6 and 7 are both provided to the comparator 8. The comparator 8 then outputs the control signal 12 based on a result obtained through determination logic, which will be described later. In response to the control signal 12, the multiplexer 2 switches, for output, between the output signal from the one-clock delay circuit I and the reference signal 9. If the comparator 8 does not output the control signal 12 in accordance with the result obtained through the determination logic which will be described later, the multiplexer 2 surely does not go through its switching operation.

Figure 2A:
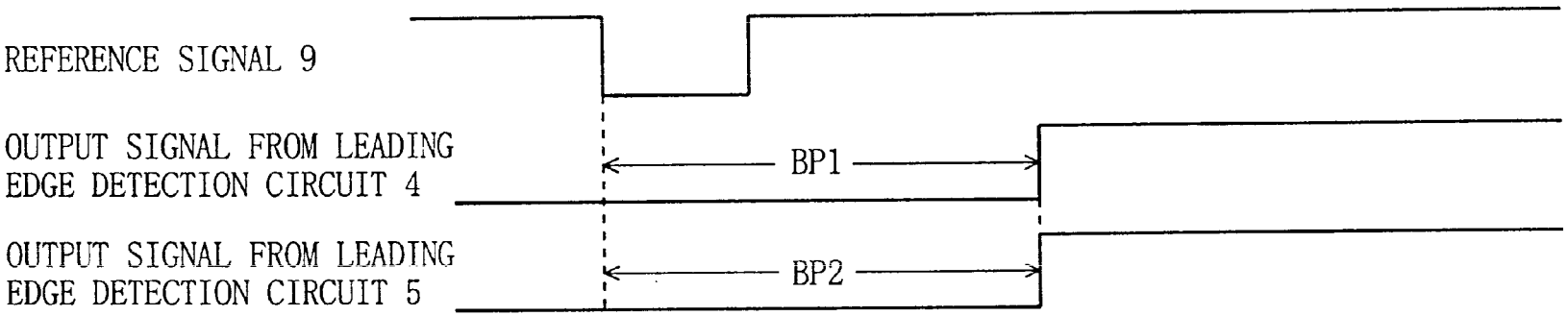
FIGS. 2(*a*) and (*b*) are diagrams for explaining the operation of the video signal processing device according to the first embodiment of the present invention.
Figure 2B:
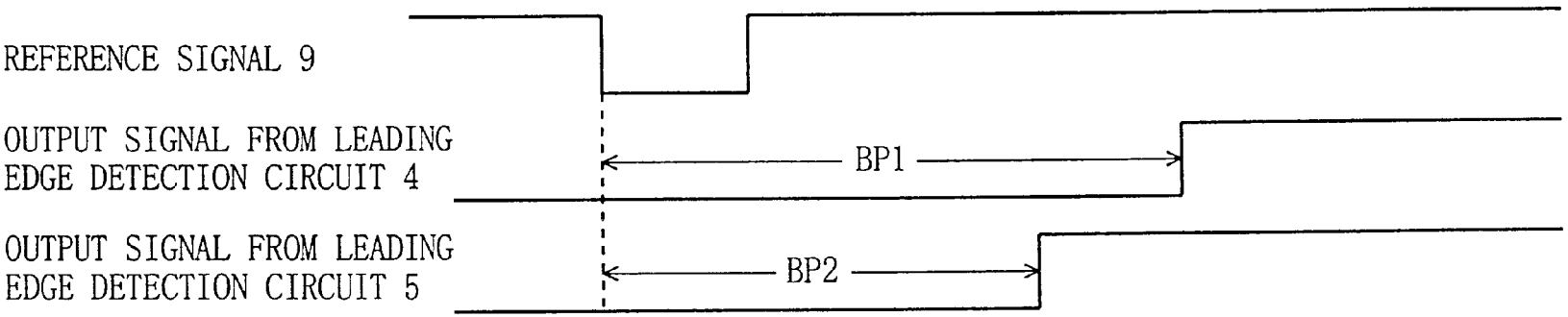

Next, the determination operation of the comparator 8 is described in detail by referring to FIGS. 2(*a*) and (*b*). FIGS. 2(*a*) and (*b*) are time charts showing the relationship between the reference signal 9 and the output signals from the first and second leading edge detection circuits 4 and 5. Specifically, FIG. 2(*a*) shows a case where the head data (data on the left end on the display) in the valid video signal region is outputted from the first phase of the A/D converter 3, while FIG. 2(*b*) shows a case where the head data is outputted from the second phase of the A/D converter 3.

In the foregoing, it is already described that the back porch period is a period detected starting from the pulse position of the signal outputted from the multiplexer 2 to the head data in the valid video signal region. It is now assumed that a back porch number is a value obtained by counting the number of dots (the number of clocks) in the back porch period. In FIGS. 2(*a*) and (*b*), the back porch number for the output signal from the leading edge detection circuit 4 is denoted by BP1, and the back porch number for the output signal from the leading edge detection circuit 5 as BP2.

In FIG. 2(*a*), as described above, the head data is included in the first phase data 10. Therefore, for the output signal from the leading edge detection circuit 4 where receiving the first phase data 10, the back porch number BP1 always shows such relationship with the back porch number BP2 as an equation (1) next below.

$$BP1 \leq BP2 \quad (1)$$

This is because, if video signal data next to the head data, i.e., the data at the start of the second phase data 11, is not in the black level, BP1 and BP2 become equal to each other in value, and if in the black level, BP2 never fails to be larger than BP1.

When the above equation (1) is satisfied, the comparator does not output the control signal 12 to the multiplexer 2. Thus, the multiplexer 2 keep outputting the reference signal 9 without its switching operation. Once the reference signal 9 is received, it becomes possible for the A/D converter 3 to retain a state that the head data in the valid video signal region is always outputted from the first phase data. Therefore, once retaining such state that the head data is always outputted from the first phase data, the present video signal processing circuit basically has no need to operate thereafter.

In FIG. 2(*b*), on the other hand, the head data in the valid video signal region is included in the second phase data 1. Therefore, for the output signal from the leading edge detection circuit 5 where receiving the second phase data 11, the back porch number BP2 always shows such relationship with the back porch number BPI as an equation (2) next below.

$$BPI > BP2 \quad (2)$$

This is because, since the head data is included in the second phase data 11, the first phase data 10 in the same phase is surely the black data, and the back porch number BP2 never fails to be smaller than the back porch number BP1.

When the above equation (2) is satisfied, the comparator 8 outputs the control signal 12 to the multiplexer 2 so as to bring the multiplexer 2 to select the signal from the one-clock delay circuit 1. In response to the control signal 12, the multiplexer 2 switches its output signal. Specifically, the multiplexer 2 selects the signal from the one-clock delay circuit 1 for output to the A/D converter 3. Once the signal from the one-clock delay circuit 1 is selected, the A/D converter 3 starts regarding a signal whose phase is delayed by one clock as a reference, retaining the state that the head data in the valid video signal region is always outputted from the first phase data. This is because, as described in the foregoing, if the head data in the valid video signal region is outputted from the first phase data, the comparator 8 does not output the control signal 12 to the multiplexer 2, and accordingly the multiplexer 2 does not switch its output signal. This is the reason why, as described above, the present video signal processing circuit basically has no need to operate once such state is retained that the head data is always outputted from the first phase data.

Note herein that, even if the head data in the valid video signal region starts to be outputted from the second phase data in operation, the present video signal processing device can retain the state that the head data in the valid video signal region is always outputted from the first phase data. This is because, the comparator 8 outputs the control signal 12 to the multiplexer 2 through such determination operation described in the foregoing, and thus the multiplexer 2 switches its output signal to the reference signal 9.

As described in the foregoing, even if ahead of video data is not in the first phase output data, the video signal processing device of this embodiment is capable of displaying every pixel on a display by regarding a signal whose phase is delayed by one clock as a reference.

Note herein that, the video signal processing device of this embodiment can be such in structure that the first and second leading edge detection circuits 4 and 5 are replaced with first and second falling edge detection circuits, respectively. In such a structure, the first and second back porch detection circuits 6 and 7 operate to detect a period including both the back porch period and the valid video signal period. Even with such an alternative structure, the video signal processing device of this embodiment can operate in a similar manner.

Further, the one-clock delay circuit 1 in the present video signal processing device may be a three-clock delay circuit or a five-clock delay circuit. That means, the one-clock delay circuit 1 may be any type of circuit as far as the reference signal 9 is delayed by an odd number of clocks therein. Still further, although an A/D converter described in this embodiment is the one carrying out the two-phase processing, an A/D converter carrying out four-phase processing or six-phase processing can easily operate in a similar manner.

Second Embodiment

Figure 3:
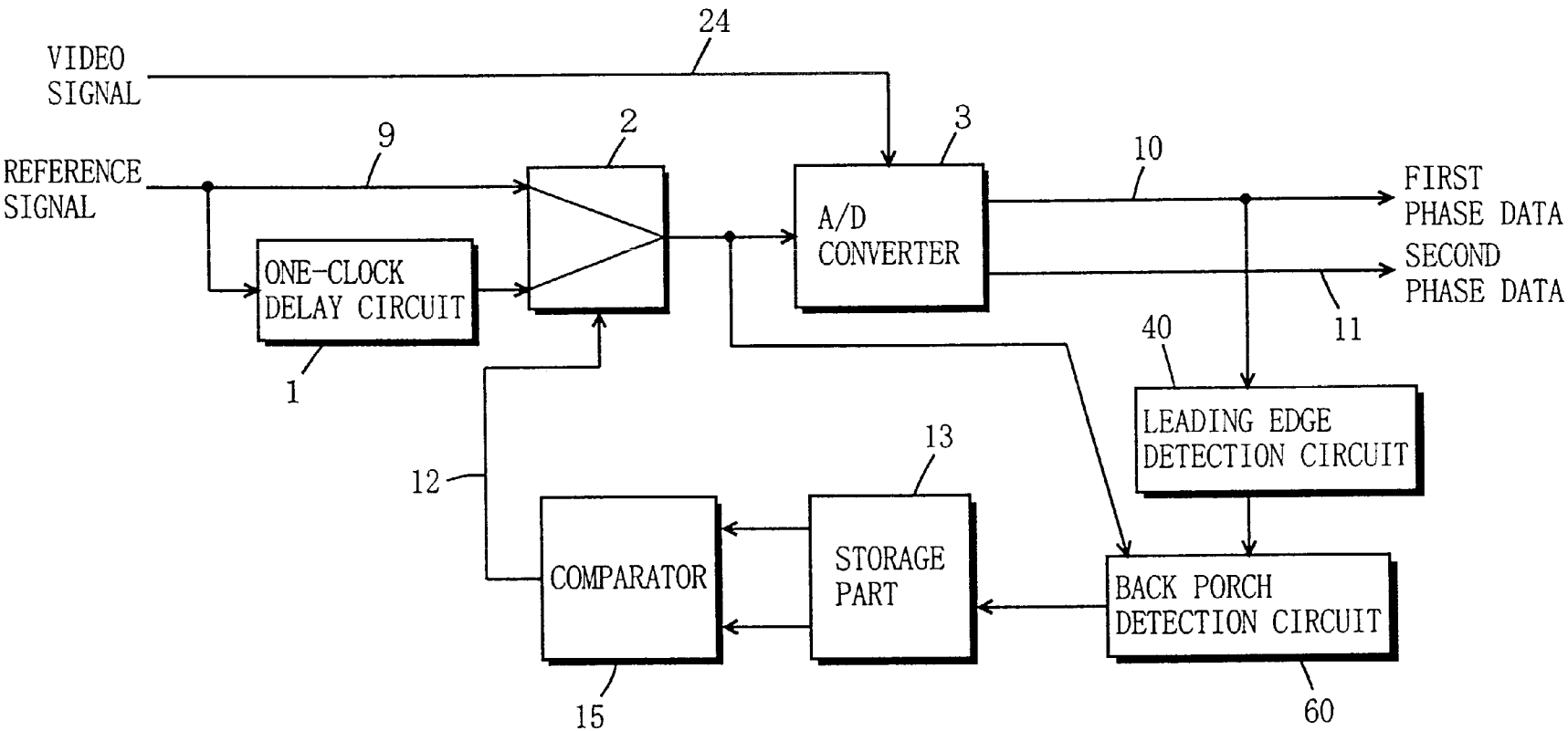
FIG. 3 is a block diagram showing the structure of a video signal processing device according to a second embodiment of the present invention.

FIG. 3 is a block diagram showing the structure of a video signal processing device according to a second embodiment of the present invention. In FIG. 3, the present video signal processing device is almost identical in structure to the above-described video signal processing device of the first embodiment. The present video signal processing device is not provided with the second leading edge detection circuit 5 and the second back porch detection circuit 7 in FIG. 1. And therein, the first leading edge detection circuit 4 in FIG. 1 is replaced with a leading edge detection circuit 40, and the first back porch detection circuit 6 with a back porch detection circuit 60, and a storage part 13 is additionally provided. These are the differences from the above-described video signal processing device of the first embodiment. Thus, in the present video signal processing device, any constituent identical to that in the video signal processing device of the first embodiment is under the same reference numeral, and is not described again. Herein, a comparator 15 is different from the comparator 8 in reference numeral since receiving a signal different from the one thereto.

In FIG. 3, in an initial state, the multiplexer 2 selects the reference signal 9 for output to the A/D converter 3 without any change. In the same manner as described above, with reference to the signal outputted from the multiplexer 2, the A/D converter 3 subjects the video signal 24 to A/D conversion and then carries out the two-phase processing so that the video signal 24 is outputted as the first phase data 10 and the second phase data 11. The first phase data 10 is provided to the leading edge detection circuit 40. The leading edge detection circuit 40 then detects a leading edge of a valid video signal region in the video signal 24. A result obtained by the detection is provided to the back porch detection circuit 60. The back porch detection circuit 60 detects a back porch period between a leading edge of the signal (herein, the reference signal 9) outputted from the multiplexer 2 and a leading edge of the valid video signal region outputted from the leading edge detection circuit 40. The back porch period thus detected is provided to the storage part 13. The storage part 13 stores the period, and keeps outputting the period to the comparator 15 at predetermined intervals.

When detecting an input only of the period, the comparator 15 outputs the control signal 12 to the multiplexer 2 so as to bring the multiplexer 2 to change its output signal to an output signal from the one-clock delay circuit 1. The reason for the comparator carrying out such operation is to have the storage part 13 store the back porch period starting from the leading edge of the reference signal 9, and then have the storage part 13 also store the back porch period starting from the leading edge of the output signal from the one-clock delay circuit 1.

In response to the control signal 12 from the comparator 15, the multiplexer 2 switches to the output signal from the one-clock delay circuit 1 for output to the A/D converter 3. The A/D converter 3 regards the received signal as a reference, and subjects the video signal 24 to A/D conversion and then carries out the two-phase conversion. In a similar manner to the above, the leading edge detection circuit 40 detects the leading edge of the valid video signal region in the video signal 24. Also, the back porch detection circuit 60 detects the back porch period in a similar manner to the above. The back porch period thus detected is provided to the storage part 13. The storage part 13 then provides both the received back porch period and the stored back porch period to the comparator 15. Herein, the received back porch period may be stored once into the storage part 13.

When detecting an input of those two back porch periods, the comparator 15 determines whether or not to output the control signal 12 again based on a result obtained through determination logic, which will be later described. If the control signal 12 is inputted, the multiplexer 2 switches its output signal between the output signal from the one-clock delay circuit 1 and the reference signal 9.

Figure 4A:
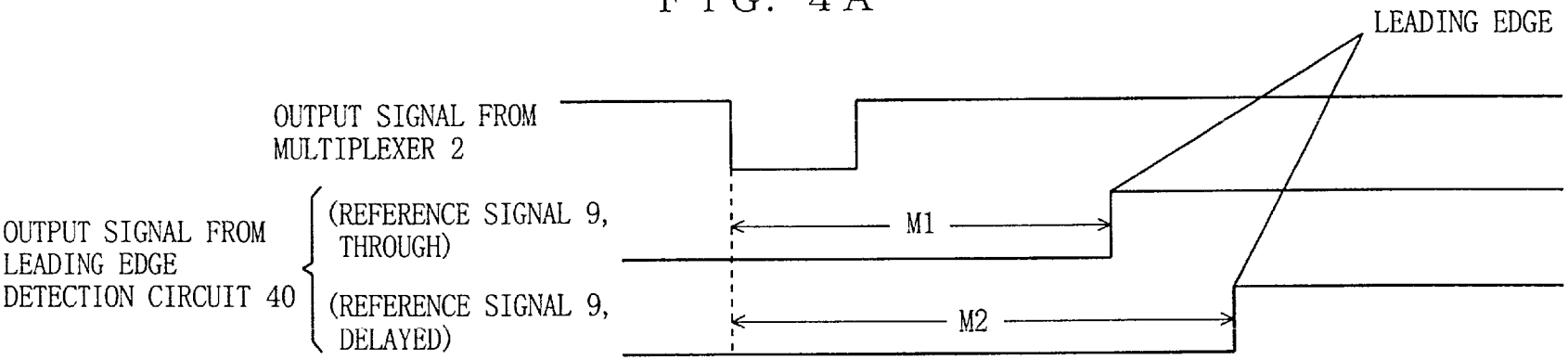
FIGS. 4(*a*) and (*b*) are diagrams for explaining the operation of the video signal processing device according to the second embodiment of the present invention.
Figure 4B:
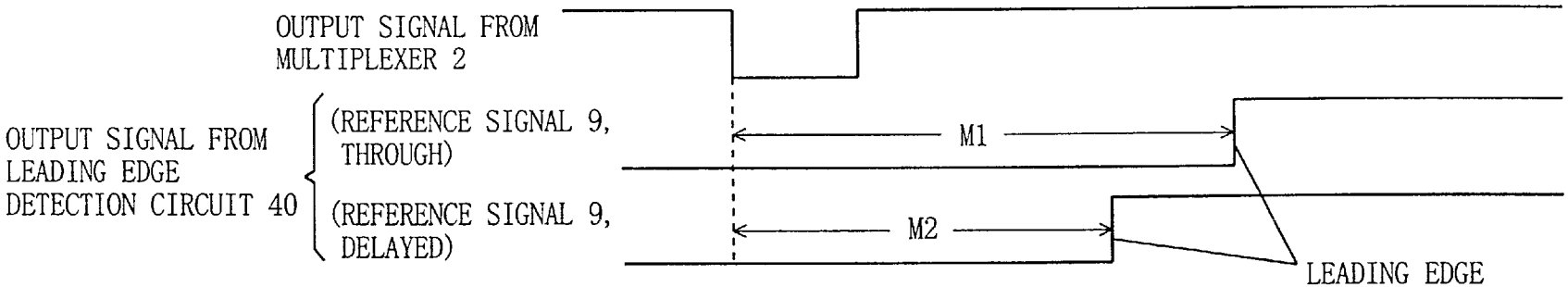

Next, the determination operation of the comparator 8 is described in detail by referring to FIGS. 4(*a*) to 6(*b*). FIGS. 4(*a*) and (*b*) are time charts showing the relationship between the reference signal 9 and the output signal from the storage part 13. Specifically, FIG. 4(*a*) shows a case where head data (data on the left end on the display) in the valid video signal region is outputted from the first phase of the A/D converter 3, while FIG. 4(*b*) shows a case where the head data is outputted from the second phase of the A/D converter 3.

Figure 5A:
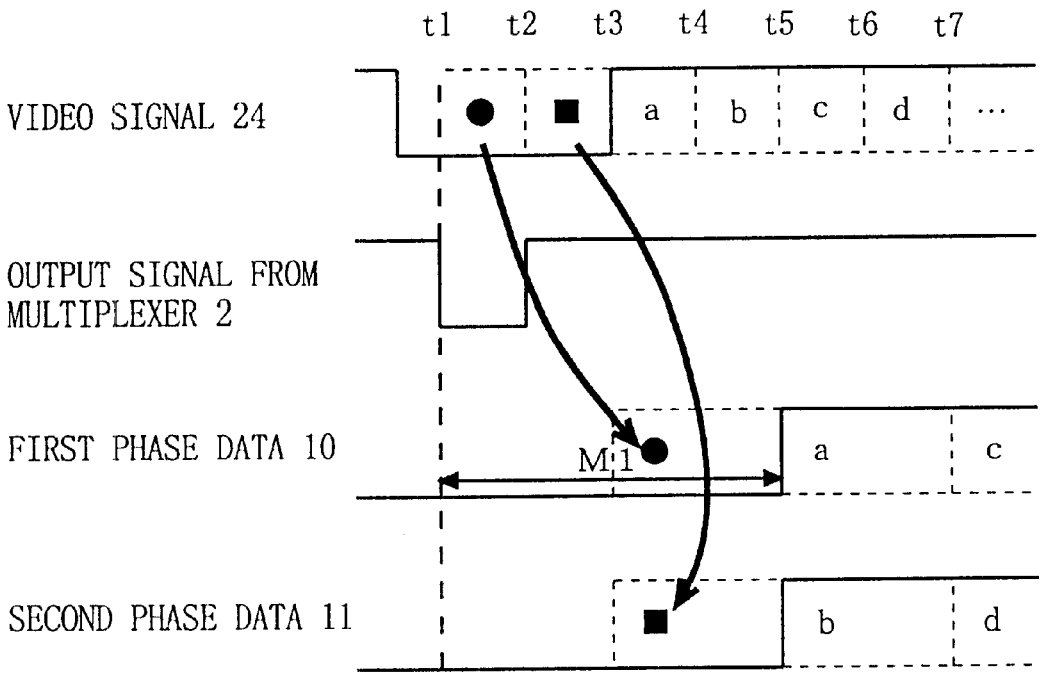
FIGS. 5(*a*) and (*b*) are diagrams showing the flow of data in a case where head data in a valid video signal region is outputted from the first phase of an A/D converter 3.
Figure 5B:
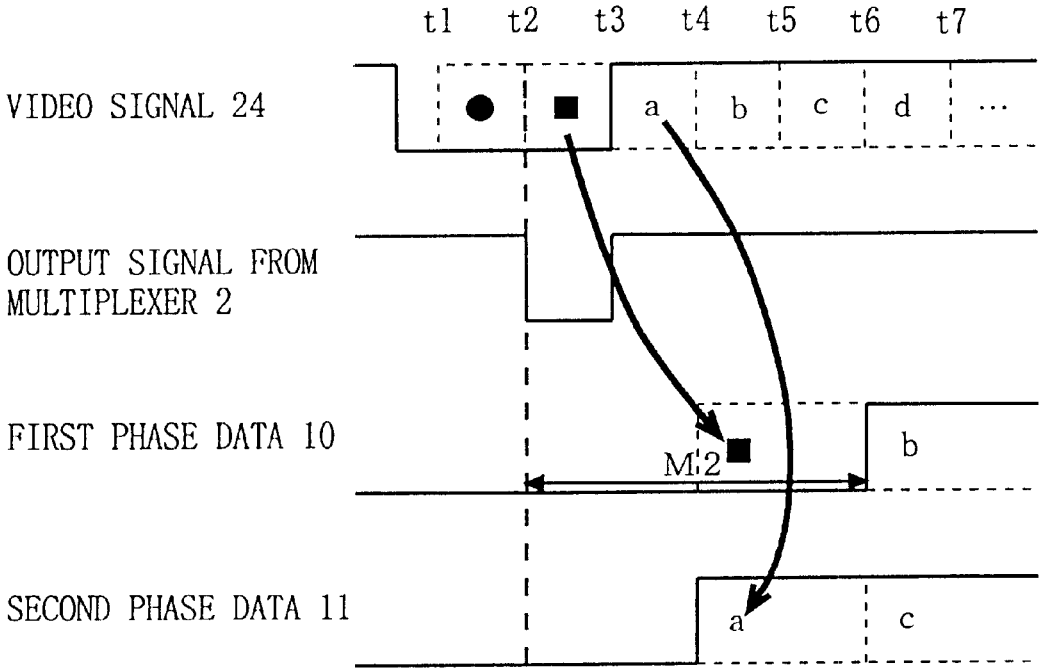

FIGS. 5(*a*) and (*b*) are time charts showing the flow of data for a case where the head data in the valid video signal region is outputted from the first phase of the A/D converter 3. Specifically, FIG. 5(*a*) shows a case where the reference signal 9 is applied to the A/D converter 3 without being delayed, while FIG. 5(*b*) shows a case where the reference signal 9 is delayed by one clock before applied to the A/D converter 3.

Figure 6A:
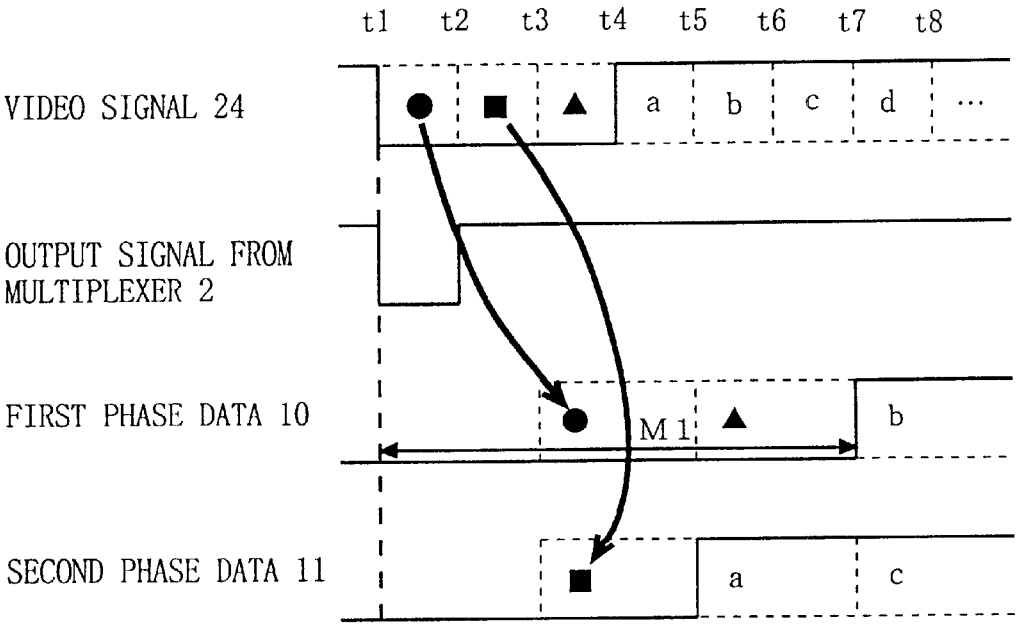
FIGS. 6(*a*) and (*b*) are diagrams showing the flow of data in a case where the head data is outputted from the second phase of the A/D converter 3.
Figure 6B:
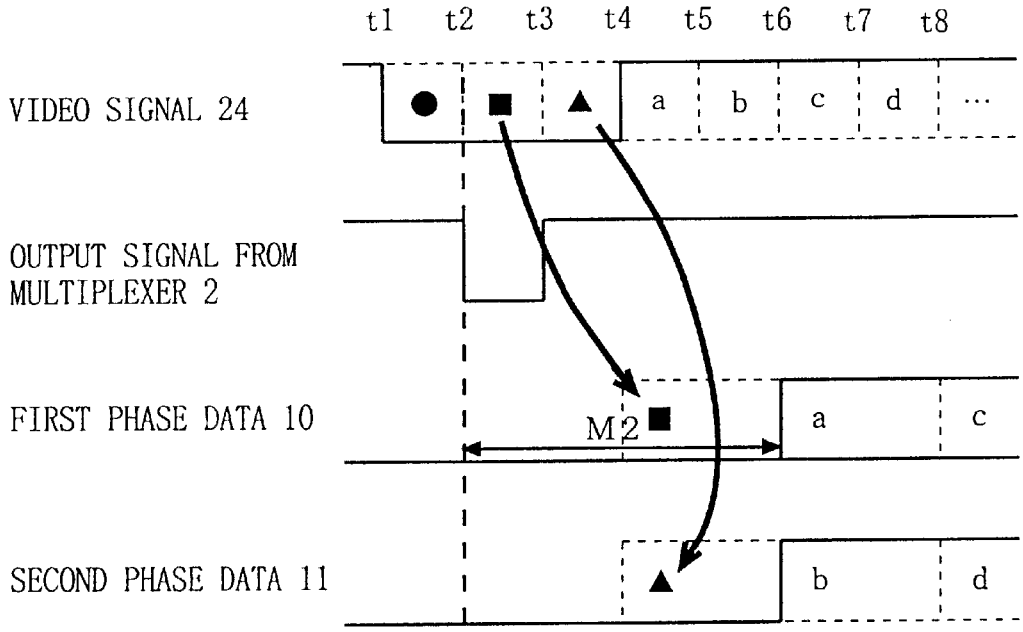

FIGS. 6(*a*) and (*b*) are time charts showing the flow of data for a case where the head data is outputted from the second phase of the A/D converter 3. Specifically, FIG. 6(*a*) shows a case where the reference signal 9 is applied to the A/D converter 3 without being delayed, while FIG. 6(*b*) shows a case where the reference signal 9 is delayed by one clock before applied to the A/D converter 3.

Similar to the above-described first embodiment, also in this embodiment, the back porch number is presumed to be a value obtained by counting the number of dots (the number of clocks) in the back porch period. In FIGS. 4(*a*) to 6(*b*), in the case that the reference signal 9 is applied to the A/D converter 3 without being delayed, the back porch number in the output signal from the storage part 13 is denoted by M1. In the case that the reference signal 9 is applied to the A/D converter 3 after being delayed by one clock, the back porch number in the output signal from the storage part 13 is denoted by M2.

In FIG. 4(*a*), in the case that the reference signal 9 is delayed by one clock before inputted to the A/D converter 3, the leading edge of the output signal from the leading edge detection circuit 40 comes one clock or more later as compared with the case that the reference signal 9 is inputted to the A/D converter 3 without being delayed. In detail, as will be described, if the head data of the video signal is accompanied by data not in the black level (ON data), the leading edge of the output signal from the leading edge detection circuit 40 comes later only by one clock in the case that the reference signal 9 is delayed only by one clock. If the data is in the black level, the leading edge thereof comes later by more clocks. Herein, since the output signal from the multiplexer 2 is delayed by one clock, the relationship between the back porch numbers MI and M2 can be expressed by an equation (3) next below.

$$M1 \leqq M2 \tag{3}$$

Next why such a relationship as expressed by the above equation (3) is established is described in detail by referring to FIGS. 5(*a*) and (*b*). In FIGS. 5(*a*) and (*b*), t1 to t7 each indicate a time, and arrows therein schematically show the two-phase processing in the A/D converter 3. Moreover, a blackened circle and square denote data in the black level in the back porch, and a to d denote video data in the valid video signal region. Herein, the video data a located immediately after the leading edge of the video signal 24 is assumed not in the black level. This is because, if the data is in the black level, such problem to be solved by the present video signal processing device that a display cannot display every data does not occur as described in the foregoing.

In FIG. 5(*a*), the leading edge of the output signal from the multiplexer 2 is at time t1. Thus, in response to the video signal 24 inputted at time t1, the A/D converter 3 starts the two-phase processing. To be specific, once two types of data were inputted, the A/D converter 3 keeps simultaneously outputting the received data until completely receiving the next two data. Accordingly, the A/D converter 3 outputs the data denoted by the blackened circle and square at time t3, and outputs the video data 10 a and b at time t5. In the video signal processing device of this embodiment, only the first phase data 10 goes to the leading edge detection circuit 40. Thus, the leading edge of the output signal from the leading edge detection circuit 40 is found at time t5, and it is known that the back porch number M1 between times t1 and t5 is 4. Note herein that, since the video data a is not in the black level, M1 is determined regardless of the arrangement of the video data.

In FIG. 5(*b*), since the reference signal 9 is delayed by one clock, the leading edge of the output signal from the multiplexer 2 is at time t2. Therefore, the A/D converter 3 starts the two-phase processing in response to the video signal 24 inputted at time t2, outputs the data denoted by the blackened square and the video data a at time t4, and outputs the video data b and c at time t6. In the video signal processing device of this embodiment, only the first phase data 10 goes to the leading edge detection circuit 40. Thus, the leading edge of the output signal from the leading edge detection circuit 40 is found at time t6. It is thus known that the back porch number M2 between times t2 and t6 is 4. Note herein that, the video data b or data following thereto may be in the black level. If this is the case, the leading edge of the output signal from the leading edge detection circuit 40 will be found later than time t6. Accordingly, M2 becomes 4 or larger and never fails to be equal to or larger than M1 in value. Therefore, the relationship such as the above equation (3) is thus satisfied.

Next, in FIG. 4(*b*), in the case that the reference signal 9 is delayed by one clock before inputted to the A/D converter 3, the leading edge of the output signal from the leading edge detection circuit 40 always comes before as compared with the case that the reference signal 9 is inputted to the A/D converter 3 without being delayed. This is because, as will be described later, when the two-phase processing is carried out with respect to the one-clock delayed signal, the head data of the video signal which has been included in the second-phase data 11 is starts to be included in the first-phase data 10. Therefore, the relationship between the back porch numbers M1 and M2 can be expressed as an equation (4) next below.

$$M1>M2 \tag{4}$$

It is now described in detail why such a relationship as the above equation (4) is established by referring to FIGS. 6 (*a*) and (*b*). In FIGS. 6(*a*) and (*b*), t1 to t8 each denote a time, and arrows therein schematically show the two-phase processing in the A/D converter 3. The blackened circle, square, and triangle indicate the data in the black level in the back porch, and a to d indicate the video data in the valid video signal region. As already described in the foregoing, the video data a immediately after the leading edge of the video signal 24 is not in the black level.

In FIG. 6(*a*), the leading edge of the output signal from the multiplexer 2 is at time t1. Thus, in response to the video signal 24 inputted at time t1, the A/D converter 3 starts the two-phase processing. Thereafter, at time t3, the A/D converter 3 outputs data denoted by the blackened circle and square, at time t5, outputs data denoted by the blackened triangle and the video data a, and at time t7, outputs the video data b and c. In the video signal processing device of the present invention, only the first phase data 10 goes to the leading edge detection circuit 40. Thus, the leading edge of the output signal from the leading edge detection circuit 40 is found at time t7, and it is known that the back porch number M1 between times t1 and t7 is 6. Note herein that, the video data b or the video data b with the data following thereto may be in the black level. In such case, the leading edge of the output signal from the leading edge detection circuit 40 will be found later than time t7.

In FIG. 6(*b*), since the reference signal 9 is delayed by one clock, the leading edge of the output signal from the multiplexer 2 is at time t2. Thus, in response to the video signal 24 inputted at time t2, the A/D converter 3 starts the two-phase processing, outputs data denoted by the blackened square and triangle at time t4, and outputs the video data a and b at time t6. Since only the first phase data 10 goes to the leading edge detection circuit 40 in the video signal processing device of this embodiment, the leading edge of the output signal from the leading edge detection circuit 40 is found at time t6. It is thus known that the back porch number M2 between times t2 and t6 is 4, and rendering M2 always smaller than M1 in value. As such, such relationship as the above equation (4) is established.

When the above equation (3) is satisfied, the comparator 15 again outputs the control signal 12 to the multiplexer 2. In response thereto, the multiplexer 2 again goes through its switching operation so as to output the reference signal 9. Once the reference signal 9 is inputted, the A/D converter 3 can retains a state where the head data in the valid video signal region is outputted always from the first phase data. Therefore, similar to the first embodiment, the present video signal processing circuit basically has no need to operate once such a state where the head data is always outputted from the first phase data is retained.

When the above equation (4) is satisfied, the comparator 15 does not output the control signal 12 to the multiplexer 2 so as to let the multiplexer 2 keep selecting the signal from the one-clock delay circuit 1. With no control signal 12 inputted, the multiplexer 2 keeps selecting the signal from the one-clock delay circuit 1 for output to the A/D converter 3. Once the signal from the one-clock delay circuit 1 is selected, the A/D converter 3 regards a signal whose phase is delayed by one clock as a reference, and thus, the head data in the valid video signal region is assured to always be outputted from the first phase data. As such, similar to the case in the first embodiment, the present video signal processing circuit has no need to operate once such a state where the head data is always outputted from the first phase data is retained.

Note herein that, even if the head data in the valid video signal region starts to be outputted from the second phase data in operation, similar to the first embodiment, the present video signal processing device can retain the state where the head data in the valid video signal region is always outputted from the first phase data.

As described in the foregoing, according to the video signal processing device of the present invention in which a back porch period outputted from the back porch detection circuit 60 is stored in the storage part 13, and outputted to the comparator 15 for determination operation therein based on the data, a display can assuredly display every video signal thereon.

Further, compared with the video signal processing devices of the above-described first embodiment and of the later-described embodiments, the video signal processing device of this embodiment does not use the second phase data 11 outputted from the A/D converter 3 as a detection signal. Therefore, in the present video signal processing device, wiring on a substrate can be reduced in area, for example.

Herein, although the first phase data 10 is used as the detection signal in this embodiment, the second phase data 11 can surely be used. Moreover, the video signal processing device of this embodiment can be provided with a falling edge detection circuit instead of the leading edge detection circuit 40. If this is the case, the back porch detection circuit 60 operates to detect a period including both the back porch period and the valid video signal period. In such an alternative structure, the video signal processing device of this embodiment can operate in a similar manner.

Still further, similar to the case in the first embodiment, the one-clock delay circuit 1 may be any type of circuit as long as the reference signal 9 is delayed by an odd number of clocks therein. Also, the A/D converter 3 may carry out four-phase processing or six-phase processing, which can easily operate in a similar manner.

Third Embodiment

Figure 7:
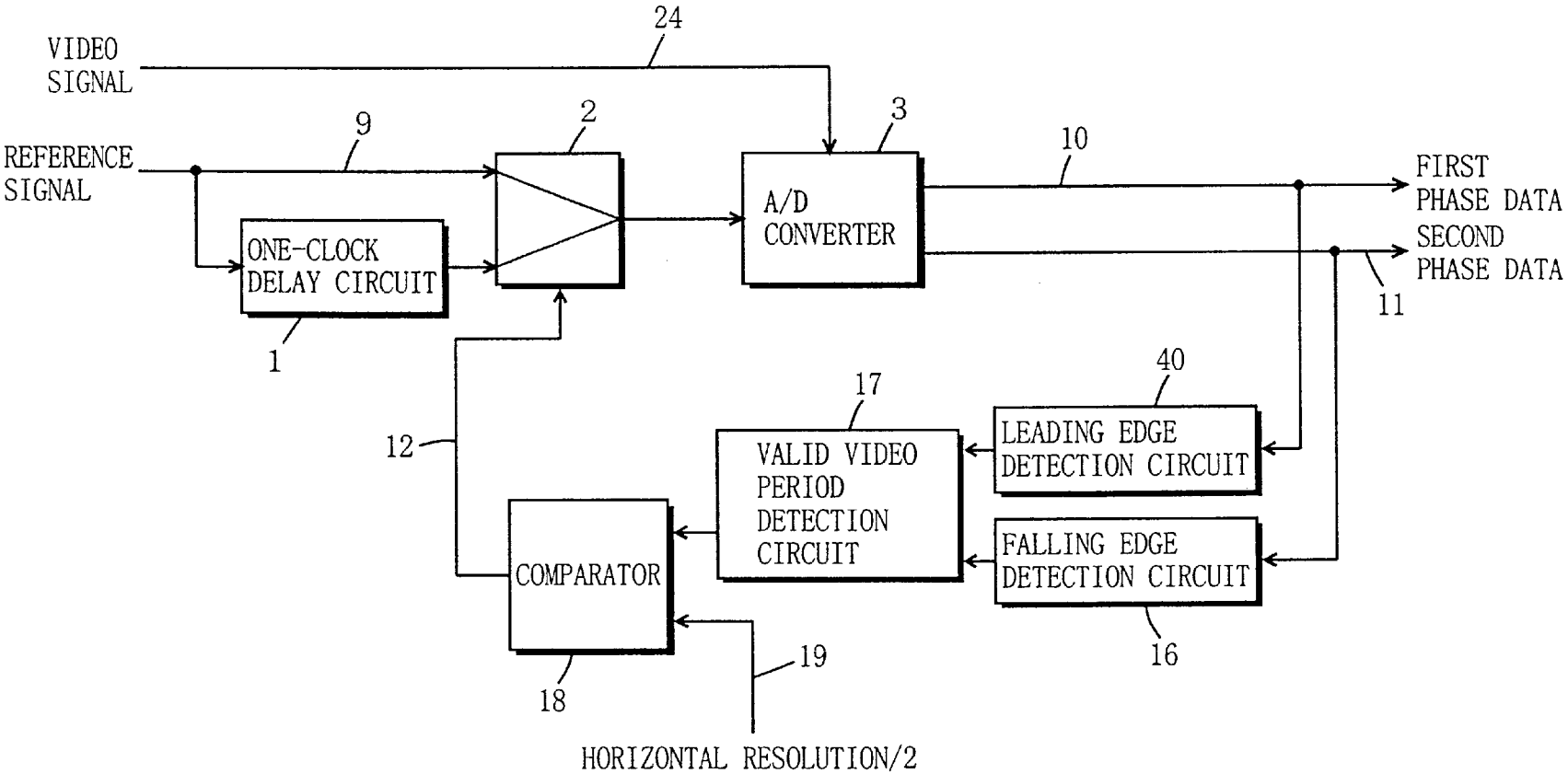
FIG. 7 is a block diagram showing the structure of a video signal processing device according to a third embodiment of the present invention.

FIG. 7 is a block diagram showing the structure of a video signal processing device according to a third embodiment of the present invention. In FIG. 7, the present video signal processing device is almost identical in structure to the above-described video signal processing device of the second embodiment in FIG. 3. The present video signal processing device is not provided with the back porch detection circuit 60 and the storage part 13 in FIG. 3, but is newly provided with a falling edge detection circuit 16 and a valid video signal period detection circuit 17. These are the differences from the above-described video signal processing device of the second embodiment. Thus, in the present video signal processing device, any constituent identical to that in the video signal processing device of the second embodiment is under the same reference numeral, and is not described again. Herein, a comparator 18 is different from the comparator 15 in reference numeral since it receives a signal different from the one thereto. Described next below is the operation of such a structured present video signal processing device with reference to FIGS. 8 and 9(*a*) and (*b*).

Figure 8:
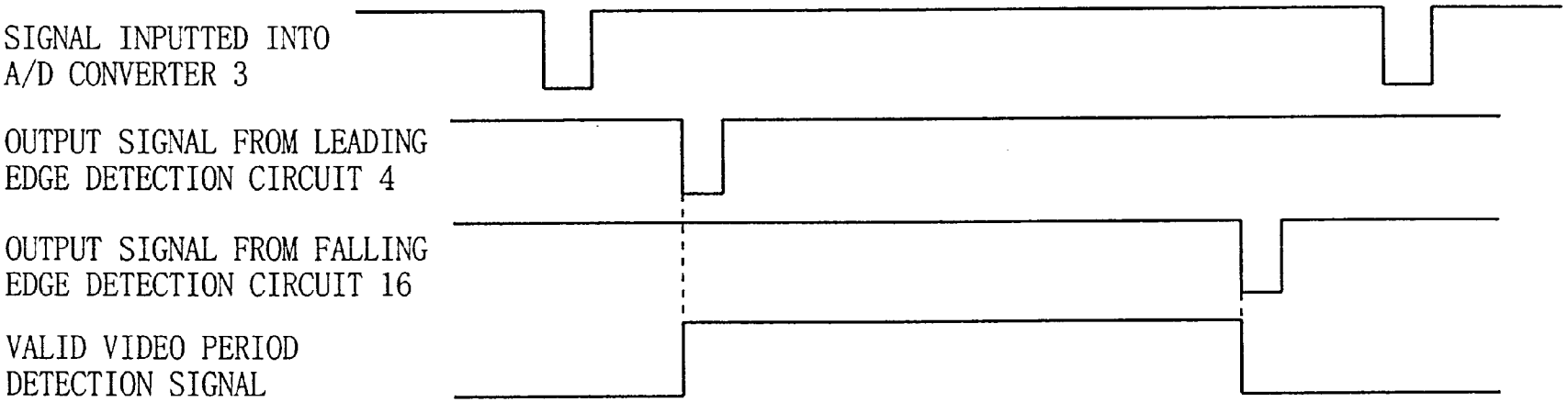
FIG. 8 is a diagram for explaining the operation of the video signal processing device according to the third embodiment of the present invention.

First, once the first phase data 10 is inputted from the A/D converter 3, the leading edge detection circuit 40 detects a position where the first phase data 10 first rises with reference to a pulse of an output signal from the multiplexer 2. A result obtained by the detection is outputted in a form of pulse signal as shown in FIG. 8.

On the other hand, in response to the second phase data 11 from the A/D converter 3, the falling edge detection circuit 16 detects a position where the second phase data 11 falls last with reference to a pulse position of the output signal from the multiplexer 2. The result obtained thereby is outputted in such a form of a pulse signal as shown in FIG. 8.

The signals outputted from the leading edge detection circuit 40 and the falling edge detection circuit 16 go to the valid video signal period detection circuit 17. From those signals, the valid video signal period detection circuit 17 generates a valid video signal detection signal therein as shown in FIG. 8. Moreover, the valid video signal period detection circuit 17 includes a counter circuit, and counts the above valid video period detection signal for pulse width on the basis of the number of dot clocks from the image signal source, and detects the number of pixels included in the valid video signal processing period. As such, the number of dot clocks from the image signal source helps the valid video period detection circuit 17 count in a correct manner. Note herein that, by the two-phase processing carried out in the A/D converter 3, the number of pixels is reduced to half of that in the valid video period for the actual video signal 24.

The comparator 18 receives the number of pixels included in the valid video signal period detected by the valid video period detection circuit 17. The comparator 18 also receives, from a value output part which is not shown, a value half of the horizontal resolution in the image signal source connected to the present video signal processing device. Here, the horizontal resolution in the image signal source can be easily calculated from frequencies of a horizontal synchronizing signal and a vertical synchronizing signal unique to the image signal source. Based on a result obtained by subjecting each received value to a predetermined determination logic, the comparator 18 outputs the control signal 12 to the multiplexer 2. In response to the control signal 12, the multiplexer 2 switches its output signal between the output signal from the one-clock delay circuit 1 and the reference signal 9. Herein, if the comparator 18 does not to output the control signal 12 according to the result obtained by the determination logic which will be later described, the multiplexer 2 surely does not go through its switching operation.

Figure 9A:
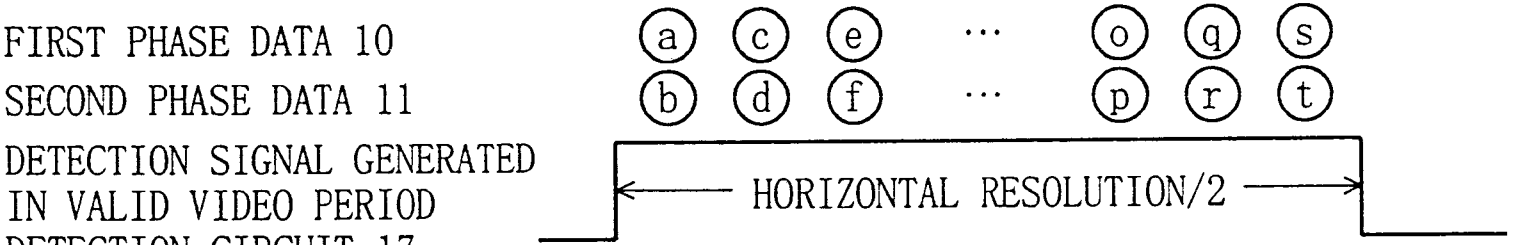
FIGS. 9(*a*) and (*b*) are diagrams showing the relationship among a detection signal generated in a valid video period detection circuit 17, first phase data 10, and second phase data 11.
Figure 9B:
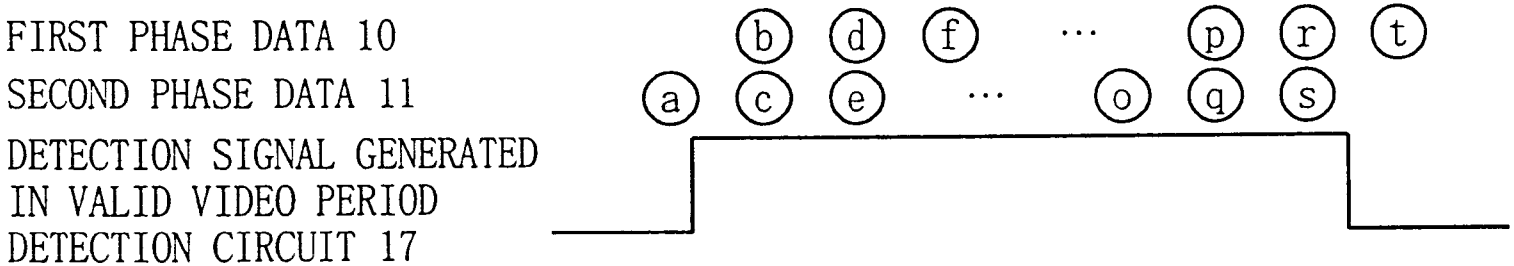

Next, it is described in detail the determination operation of the comparator 18 by referring to FIGS. 9(*a*) and (*b*). FIGS. 9(*a*) and (*b*) are time charts showing the relationship among the detection signal generated in the valid video period detection circuit 17, the first phase data 10, and the second phase data 11. Specifically, FIG. 9(*a*) shows a case where head data (data on the left end on the display) in the valid video signal region is outputted from the first phase of the A/D converter 3, while FIG. 9(*b*) shows a case where the head data is outputted from the second phase of the A/D converter 3.

In FIGS. 9, a to t denote data included in the video signal 24 provided to the A/D converter 3. For convenience, each of a to t is assumed to be ON. In this embodiment, needless to say, the data included in the video signal 24 may be in the black level.

First, as shown in FIG. 9(*a*), head data (data on the left end on the display) a in the valid video signal region is included in the first phase data 10. Thus, the data b which is the second from the head is included in the second phase data 11 at the same phase position as a in the first phase data. In this manner, the A/D converter 3 subjects 20 pieces of data from data a to data t to the two-phase processing.

The leading edge and the falling edge of the detection signal generated in the valid video period detection circuit 17 coincide with the leading edge of the first phase data 10 and the falling edge of the second phase data 11, respectively. Accordingly, the data a to data t fit in a range of a pulse width of the detection signal generated in the valid video period detection circuit 17. If this is the case, as shown in FIG. 9(*a*), such a relationship as an equation (5) is established between the number of pixels detected by the valid video period detection circuit 17 and the horizontal resolution.

$$\text{Detected Number of Pixels} = \text{Horizontal Resolution}/2 \quad (5)$$

When the above equation (5) is satisfied, the comparator 18 does not output the control signal 12 to the multiplexer 2. The multiplexer 2 thus outputs the reference signal 9 without going through its switching operation. Once the reference signal 9 is inputted, the A/D converter 3 can retain such a state that the head data in the valid video signal region is always outputted from the first phase data. Accordingly, similar to the case in the first embodiment, the present video signal processing circuit basically has no need to operate once such a state that the head data is always outputted from the first phase data is retained.

Next, as shown in FIG. 9(*b*), the head data (data on the left end of the display) a in the valid video signal region is included in the second phase data 11. Thus, the data b second from the head is included in the second phase data 11 at a position having the one-clock-delayed phase relationship with the position of a in the first phase data. As such, the A/D converter 3 subjects 20 pieces of data from data a to data t to the two-phase processing.

Here, the leading edge and the falling edge of the detection signal generated in the valid video period detection circuit 17 coincide with the leading edge of the first phase data 10 and the falling edge of the second phase data 11, respectively. Accordingly, the phase of the data a which is the head data in the second phase data 11 is delayed by one clock from the leading edge of the first phase data 10, while the phase of the data t which is the last data in the first phase data 10 is delayed by one clock from the falling edge of the second phase data 11. Thus, neither data fits in the range of the pulse width of the detection signal generated in the valid video period detection circuit 17. If so, as shown in FIG. 9(*b*), the number of pixels detected by the valid video period detection circuit 17 and the horizontal resolution has such a relationship as an equation (6) next below.

$$\text{Detected Number of Pixels}=(\text{Horizontal Resolution}/2)-1 \quad (6)$$

When the above-equation (6) is satisfied, the comparator 18 outputs the control signal 12 to the multiplexer 2 so as to bring the multiplexer 2 to select a signal from the one-clock delay circuit 1. In response to the control signal 12, the multiplexer 2 switches its output signal. To be specific, the multiplexer 2 selects a signal from the one-clock delay circuit 1 for output to the A/D converter 3. Once the signal from the one-clock delay circuit 1 is selected, the A/D converter 3 regards a one-clock-delayed signal as a reference, retaining the state that the head data in the valid video signal region is always outputted from the first phase data. Therefore, similar to the case in the first embodiment, the present video signal processing circuit basically has no need to operate once the state that the head data is always outputted from the first phase data is retained.

Note herein that, even if the head data in the valid video signal region is started to be outputted from the second phase data in operation, similar to the case in the first embodiment, the present video signal processing device can retain the state that the head data in the valid video signal region is always outputted from the first phase data.

As described in the foregoing, according to such a structured video signal processing device of the present invention that the valid video period detection circuit 17, where receiving pulses detected by the leading edge detection circuit 40 and the falling edge detection circuit 16, detects the number of pixels in the valid video period, and the comparator 18 receives the number of pixels and a value half of the horizontal resolution for comparison, a display can assuredly display every video signal thereon.

Note herein that, although each of the video data a to t in the valid video signal region in the video signal 24 is assumed to be ON in this embodiment, the present video signal processing device operates in a similar manner to the above if only the data a and t is ON. Further, the one-clock delay circuit 1 may be any type of circuit as far as the reference signal 9 is delayed by the odd number of clocks therein. Still further, the A/D converter 3 may be carrying out four-phase processing or six-phase processing, which can easily operate in a similar manner.

Fourth Embodiment

Figure 10:
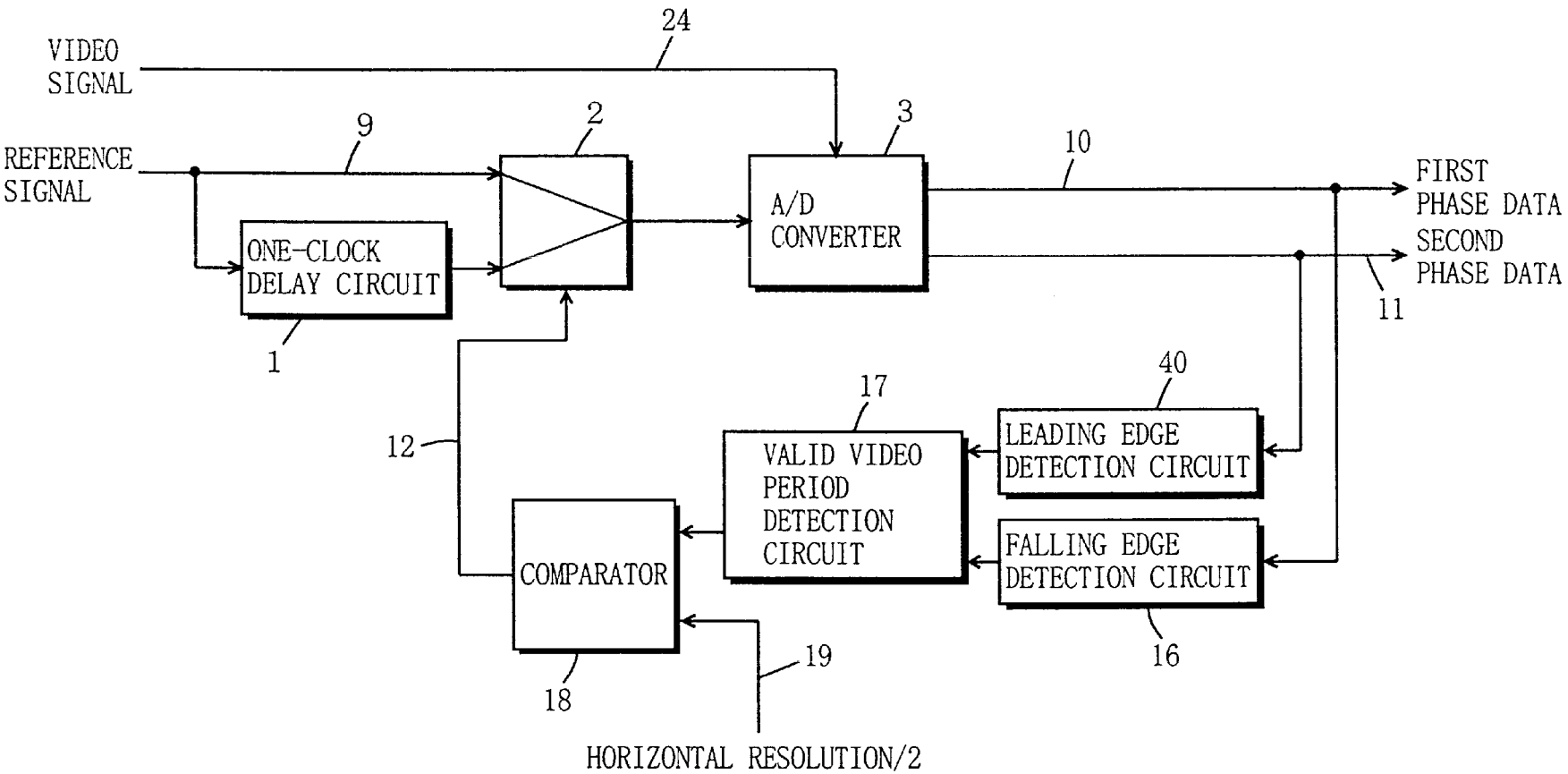
FIG. 10 is a block diagram showing the structure of a video signal processing device according to a fourth embodiment of the present invention.

FIG. 10 is a block diagram showing the structure of a video signal processing device according to a fourth embodiment of the present invention. In FIG. 10, the present video signal processing device is almost identical in structure to the above-described video signal processing device of the third embodiment in FIG. 7. Thus, constituents in the present video signal processing device are the same as those in the video signal processing device of the third embodiment, and thus are under the same reference numerals and not described again. Note that, in FIG. 7, the leading edge detection circuit 40 receives the first phase data 10 and the falling edge detection circuit 16 receives the second phase data 11, but in the present video signal processing device, the leading edge detection circuit 40 receives the second phase data 11 and the falling edge detection circuit 16 receives the first phase data 10. Described below is the reason for such differences.

As described in the foregoing, in the video signal processing device of the third embodiment, the valid video signal in the video signal 24 provided to the A/D converter 3 needs to be risen at both ends (i.e., the data needs to be ON). For example, in FIG. 9(*a*), with the head data a being OFF (i.e., data in the black level), the detection signal generated in the valid video period detection circuit 17 is less than a half of the horizontal resolution in the image signal source. Thus, the comparator 18 outputs the control signal 12 so as to bring the multiplexer 2 to switch its outputs.

However, even if the output of the multiplexer 2 is switched, the detection signal generated in the valid video period detection circuit 17 remains less than half of the horizontal resolution in the image signal source. As a result, the comparator 18 again outputs the control signal 12 so as to bring the multiplexer 2 to switch its output. Consequently, the comparator 18 falls into an endless loop in operation.

As such, with such a structured video signal processing device of the third embodiment, as described above, the video signal 24 needs to be conditionally restricted to be ON at both ends. If not conditionally restricted, the video signal processing device needs to be additionally provided with a constituent to detect whether the comparator 18 falls into the above-described endless loop, rendering the circuit complicated and the cost increased.

Therefore, with the present video signal processing device of this embodiment structured as shown in FIG. 10, such a problem of falling into the endless loop in the video signal processing device of the third embodiment can be easily avoided. Next below, the operation of the present video signal processing device is described with reference to FIGS. 11(*a*) and (*b*).

Figure 11A:
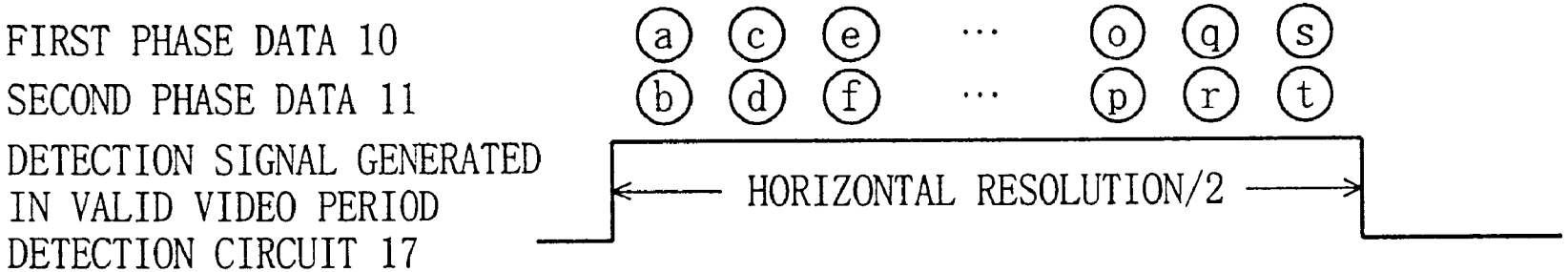
FIGS. 11(*a*) and (*b*) are diagrams for explaining the operation of the video signal processing device according to the fourth embodiment of the present invention.
Figure 11B:
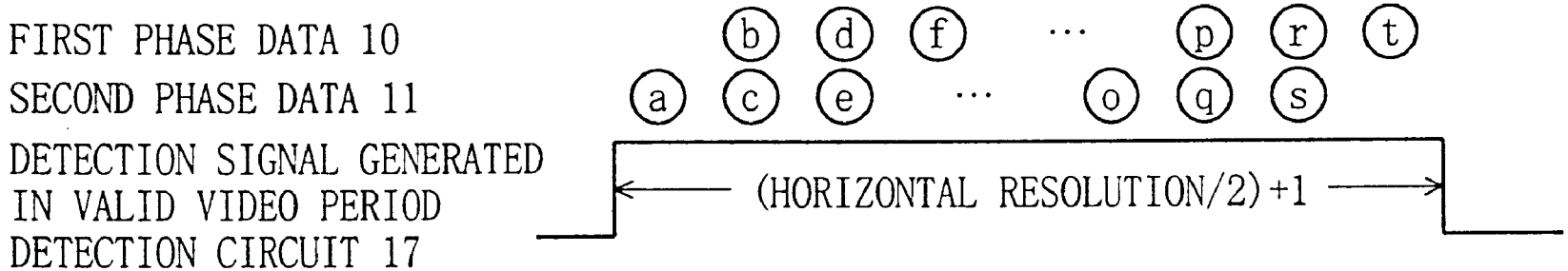

FIGS. 11(*a*) and (*b*) are time charts showing the relationship among the detection signal generated in the valid video period detection circuit 17, the first phase data 10, and the second phase data 11. Specifically, FIG. 11(*a*) shows a case where the head data (data displayed on the left end on the display) in the valid video signal region is included in the first phase data 10 from the A/D converter 3, while FIG. 11(*b*) shows a case where the head data is included in the second phase data from the A/D converter 3.

In FIGS. 11(*a*) and (*b*), a to t denote the data included in the video signal 24 provided to the A/D converter 3. Herein, for convenience, each of the data a to t is assumed to be ON. In this embodiment, the case that the video signal 24 includes data in the black level will be described later.

First, in the case as shown in FIG. 11(*a*), the head data (data displayed on the led end on the display) a in the valid video signal region is included in the first phase data 10. Therefore, the data b second from the head is included in the second phase data 11 at the same phase position as the first phase data a. As such, the A/D converter 3 subjects 20 pieces of data from data a to data t to the two-phase processing.

The leading edge and the falling edge of the detection signal generated in the valid video period detection circuit 17 coincide with the leading edge of the second phase data 11 and the falling edge of the first phase data 10, respectively. Accordingly, the data a to data t fit in a range of the pulse width of the detection signal generated in the valid video period detection circuit 17. If this is the case, as shown in FIG. 11(*a*), such a relationship as an equation (7) is established between the number of pixels detected by the valid video period detection circuit 17 and the horizontal resolution.

$$\text{Detected Number of Pixels} = \text{Horizontal Resolution}/2 \quad (7)$$

When the above equation (7) is satisfied, the comparator 18 outputs the control signal 12 to the multiplexer 2 so as to bring the multiplexer 2 to select the reference signal 9. In response to the control signal 12, the multiplexer 2 selects the reference signal 9 corresponding to the control signal for output to the A/D converter 3. Once receiving the reference signal 9, the A/D converter 3 can retain a state that the head data in the valid video signal region is always outputted from the first phase data. Therefore, once retaining the state that the head data is always outputted from the first phase data, similar to the case in the first embodiment, the present video signal processing circuit basically has no need to operate thereafter.

Next, in the case as shown in FIG. 11(*b*), the head data (data displayed on the left end on the display) a in the valid video signal region is included in the second phase data 11. Accordingly, the data b second from the head is included in the second phase data 11 at a position having the one-clock-delayed phase relationship with the position of a in the first phase data. As such, the A/D converter 3 subjects 20 pieces of data from data a to data t to the two-phase processing.

The leading edge and the falling edge of the detection signal generated in the valid video period detection circuit 17 coincide with the leading edge of the second phase data 11 and the falling edge of the first phase data 10, respectively. Accordingly, the data a being the head data in the second phase data 11 and the data 11 being the last data in the first phase data 10 both fit in a range of the pulse width of the detection signal generated in the valid video period detection circuit 17. If this is the case, as shown in FIG. 11(*b*), such a relationship as an equation (8) is established between the number of pixels detected by the valid video period detection circuit 17 and the horizontal resolution.

$$\text{Detected Number of Pixels} = (\text{Horizontal Resolution}/2)+1 \quad (8)$$

Since such equation (8) as in the above is established, by taking the above-described equation (7) into consideration, the number of pixels detected by the valid video period detection circuit 17 and the horizontal resolution have such a relationship therebetween as an equation (9) if the above equation (8) is expressed by an inequality.

$$\text{Detected Number of Pixels} > \text{Horizontal Resolution}/2 \quad (9)$$

When the above equation (9) is satisfied, the comparator 18 outputs the control signal 12 to the multiplexer 2 so as to bring the multiplexer 2 to select the signal from the one-clock delay circuit 1. In response to the control signal 12, the multiplexer 2 switches its output signal. Once the signal from the one-clock delay circuit is selected, the A/D converter 3 starts regarding a signal whose phase is delayed by one clock as a reference, retaining a state that the head data in the valid video signal region is always outputted from the first phase data. Therefore, once retaining the state that the head data is always outputted from the first phase data, similar to the case in the first embodiment, the present video signal processing circuit basically has no need to operate thereafter.

Note herein that, even if the head data in the valid video signal region starts to be outputted from the second phase data in operation, similar to the case in the first embodiment, the present video signal processing device can retain the state that the head data in the valid video signal region is always outputted from the first phase data.

In FIGS. 11(*a*) and (*b*), described next is a case where an arbitrary pixel is OFF. A state that the video signal 24 is always one pixel short on the display is observed only when the above equation (9) is satisfied. This is because, such a pixel shortage is not observed when the head or the last of the video data is in the black level, but the video data needs to be ON at both ends in order to satisfy the equation (9).

Thus, when an equation (10) is satisfied, the comparators 18 retains the output state from the multiplexer 2 for output to 15 the A/D converter without any change.

$$\text{Detected Number of Pixels} \leqq \text{Horizontal Resolution}/2 \quad (10)$$

When the above-described equation (9) is satisfied, the comparator 18 outputs the control signal 12 so as to switch the output from the multiplexer 2. With such operation of the comparator 18, the present video signal processing device can bring the display to display a video without pixel shortage.

As described in the foregoing, according to such a structured present video signal processing device that the valid video period detection circuit 17 where receiving detection pulses detected by the leading edge detection circuit 40 and the falling edge detection circuit 16 detects the number of pixels, and the comparator 18 receives the detected number of pixels and a value half of the horizontal resolution for comparison, a display can assuredly display every video signal thereon.

In this embodiment, similarly to the case in the first embodiment, the one-clock delay circuit 1 may be any type of circuit as far as the reference signal 9 is delayed by an odd number of clocks therein. Also, the A/D converter 3 may carry out four-phase processing or six-phase processing, which can easily operate in a similar manner.

Fifth Embodiment

Figure 12:
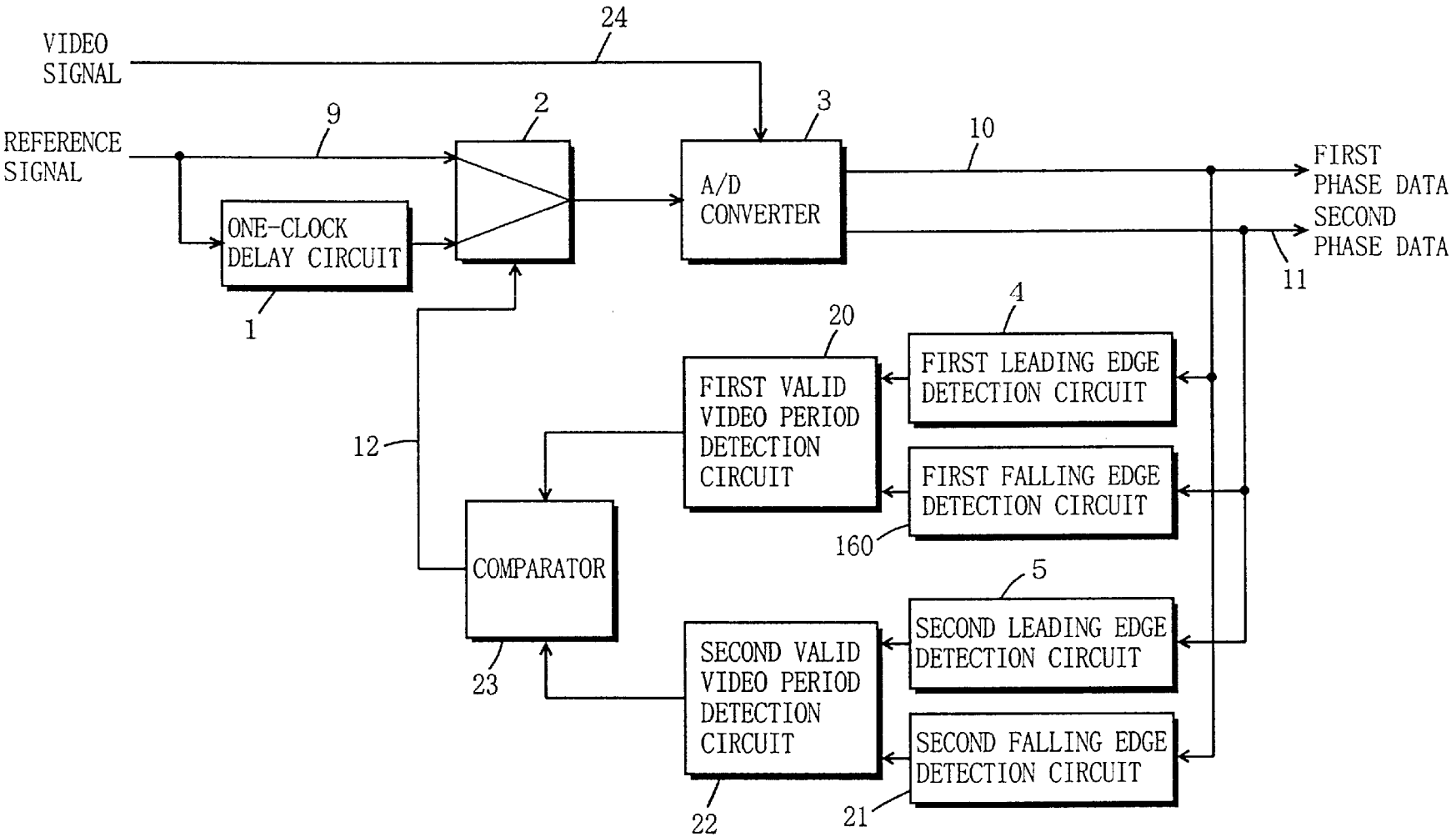
FIG. 12 is a block diagram showing the structure of a video signal processing device according to a fifth embodiment of the present invention.

FIG. 12 is a block diagram showing the structure of a video signal processing device according to a fifth embodiment of the present invention. In FIG. 12, the present video signal processing device is almost identical in structure to the above-described video signal processing device of the third embodiment in FIG. 7. Note that, the present video signal processing device is provided with a first leading edge detection circuit 4, a first falling edge detection circuit 16, and a first valid video period detection circuit 20 instead of the leading edge detection circuit 40, the falling edge detection circuit 16, and the valid video period detection circuit 17 in FIG. 7. The present video signal processing device is also provided with a second leading edge detection circuit 5, a second falling edge detection circuit 21, and a second valid video period detection circuit 22. These are the differences from the above-described video signal processing device of the third embodiment. Thus, in the present video signal processing device, any constituent identical to that in the video signal processing device of the third embodiment is under the same reference numeral, and is not described again. Herein, a comparator 23 is different from the comparator 18 in reference numeral since it receives a signal different from the one thereto.

Focusing on a signal applied to the leading edge detection circuits 4 and 5, the falling edge detection circuits 160 and 21, and the valid video period detection circuits 20 and 22, the present video signal processing device may be a combination, in structure, of the video signal processing device of the above-described third embodiment in FIG. 7 and the video signal processing device of the above-described fourth embodiment in FIG. 10. Details are described below.

As described in the foregoing, the video signal processing devices of the third and fourth embodiments have to detect the horizontal resolution in the image signal source. This horizontal resolution in the image signal source can be estimated by detecting, generally, the frequencies of the horizontal synchronizing signal and the vertical synchronizing signal from the respective image signal sources. In the recent market, however, such estimation of the horizontal resolution in the frequencies of the horizontal synchronizing signal and the vertical synchronizing signal may not be applicable to some image signal sources.

Therefore, in order for the display to deal with such image signal sources, the device needs to be structured differently so as to recognize such image signal sources. Moreover, if such image signal sources vary in type, the device thus differently-structured becomes larger in size, enlarging the circuit in its entirety.

By taking these into factors consideration, the video signal processing device of this embodiment can easily clear the above-described problems with the structure as shown in FIG. 12. Next below, the operation of the present video signal processing device is described by referring to FIGS. 13(*a*) and (*b*).

Figure 13A:
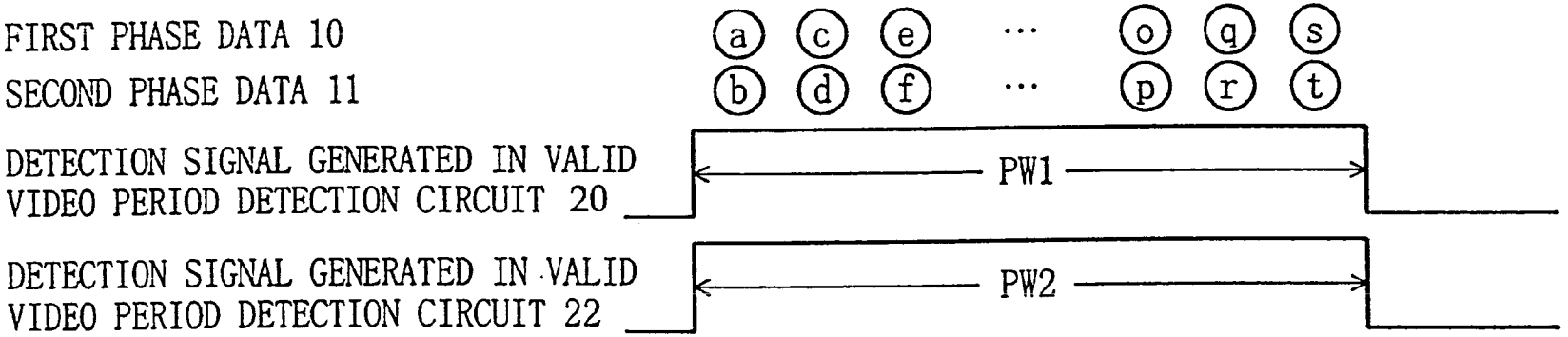
FIGS. 13(*a*) and (*b*) are diagrams for explaining the operation of the video signal processing device according to the fifth embodiment of the present invention.
Figure 13B:
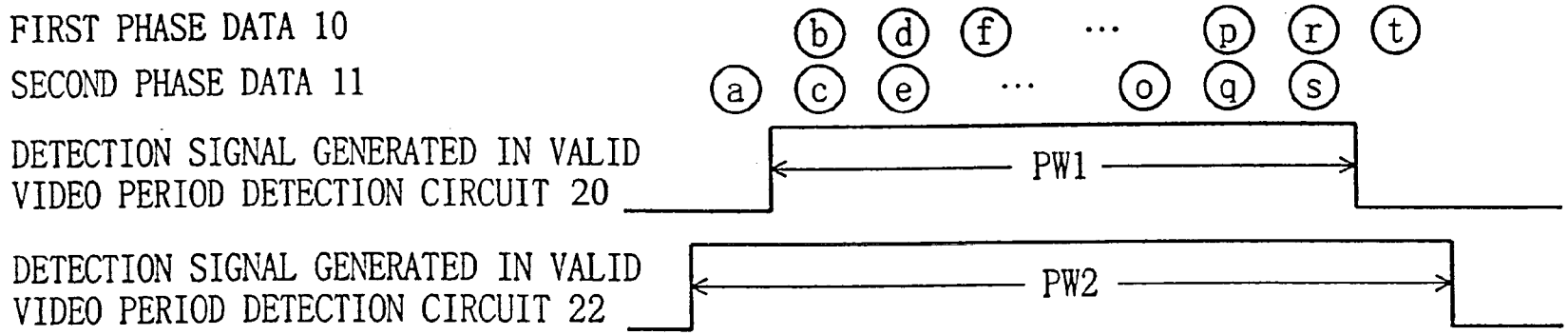

FIGS. 13(*a*) and (*b*) are time charts showing the relationship among the detection signals generated in the valid video period detection circuits 20 and 22, the first phase data 10, and the second phase data 11. Specifically, FIG. 13(*a*) shows a case where the head data (data on the left end on the display) in the valid video signal region is included in the first phase of the A/D converter 3, while FIG. 13(*b*) shows a case where the head data is included in the second phase of the A/D converter 3.

In FIGS. 13(*a*) and (*b*), a to t denote data included in the video signal 24 provided to the A/D converter 3. For convenience, each of a to t is assumed to be ON.

First, as shown in FIG. 13(*a*), the head data (data on the left end on the display) a in the valid video signal region is included in the first phase data 10. Thus, the data b which is the second from the head is included in the second phase data 11 at the same phase position as a in the first phase data. In this manner, the A/D converter 3 subjects 20 pieces of data from data a to data t to the two-phase processing.

The leading edge and falling edge of the detection signal generated in the valid video period detection circuit 17 coincide with the leading edge of the first phase data 10 and the falling edge of the second phase data 11, respectively. This is the same operation as the video signal processing device of the third embodiment, that is, the same as the above-described case shown in FIG. 9(*a*). The leading edge and falling edge of the detection signal generated in the valid video period detection circuit 22 coincide with the leading edge of the second phase data 11 and the falling edge of the first phase data 10, respectively. This is the same operation as the video signal processing device of the fourth embodiment, that is, the same as the above-described case shown in FIG. 11(*a*).

Therefore, as shown in FIG. 13(*a*), such a relationship as an equation (11) below is established between a pulse width PW1 of the detection signal generated in the valid video period detection circuit 17 and a pulse width PW2 of the detection signal generated in the valid video period detection circuit 22.

$$PW1=PW2 \tag{11}$$

When the above equation (11) is satisfied, the comparator 23 outputs the control signal 12 to the multiplexer 2 so as to bring the multiplexer 2 to select the reference signal 9. In response to the control signal 12, the multiplexer 2 selects the reference signal 9 corresponding to the control signal for output to the A/D converter 3. As such, once receiving the reference signal 9, the A/D converter 3 can retain a state that the head data in the valid video signal region is always outputted from the first phase data. Therefore, once retaining the state that the head data is always outputted from the first phase data, the present video signal processing circuit basically has no need to operate thereafter.

Next, as shown in FIG. 13(*b*), the head data (data on the left end of the display) a in the valid video signal region is included in the second phase data 11. Thus, the data b second from the head is included in the second phase data 11 at a position having the one-clock-delayed phase relationship with the position of a in the first phase data. As such, the A/D converter 3 subjects 20 pieces of data from data a to data t to the two-phase processing.

The leading edge and falling edge of the detection signal generated in the valid video period detection circuit 17 coincide with the leading edge of the first phase data 10 and the falling edge of the second phase data 11, respectively. This is the same operation as the video signal processing device of the third embodiment, that is, the same as the above-described case shown in FIG. 9(*b*). The leading edge and falling edge of the detection signal generated in the valid video period detection circuit 22 coincide with the leading edge of the second phase data 11 and the falling edge of the first phase data 10, respectively. This is the same operation as the video signal processing device of the fourth embodiment, that is, the same as the above-described case shown in FIG. 11(*b*).

Therefore, as shown in FIG. 13(*b*), such a relationship as an equation (12) below is established between a pulse width PW1 of the detection signal generated in the valid video period detection circuit 17 and a pulse width PW2 of the detection signal generated in the valid video period detection circuit 22.

$$PW1<PW2 \tag{12}$$

When the above equation (12) is satisfied, the comparator 23 outputs the control signal 12 to the multiplexer 2 so as to let the multiplexer 2 select the signal from the one-clock delay circuit 1. In response to the control signal 12, the multiplexer 2 switches its output signal. To be specific, the multiplexer 2 selects the signal from the one-clock delay circuit 1 for output to the multiplexer 2. Once the signal from the one-clock delay circuit 1 is selected, the A/D converter 3 regards a signal whose phase is delayed by one clock as a reference, and thus, such a state that the head data in the valid video signal region is always outputted from the first phase data can be retained. As such, similar to the case in the first embodiment, the present video signal processing circuit has no need to operate once such a state that the head data is always outputted from the first phase data is retained.

Note herein that, even if the head data in the valid video signal region starts to be outputted from the second phase data in operation, similar to the case in the first embodiment, the present video signal processing device can retain the state that the head data in the valid video signal region is always outputted from the first phase data.

Next, in FIG. 13(*a*), described is a case where only the video data a and t is OFF. In such a case, the head data is not included in the first phase data 10, and the last data of the video data is not included in the second phase data 11. That is in the same state as in FIG. 11(*b*). With the above equation (12) established, the comparator 23 thus outputs the control signal 12 to the multiplexer 2 so as to bring the multiplexer 2 to select the signal from the one-clock delay circuit 1. In response to the control signal 12, the multiplexer 2 switches its output signal. To be specific, the multiplexer 2 selects the signal is received from the one-clock delay circuit 1 for output to the A/D converter 3. Once the signal from the one-clock delay circuit 1, the A/D converter 3 regards a signal whose phase is delayed by one clock as a reference, and thus, the state that the head data in the valid video signal region is always outputted from the first phase data.

At this time, the head data a in the video signal 24 is included in the second phase data 11. This may appear that the status is not ideal. However, since the video data a and t are the black data, the data has a pixel shortage from the beginning, and thus does not cause such a problem as described in the foregoing if shown on the display as it is. In FIG. 11(*b*), when only the video data a and t is OFF, the similar description is applicable.

Further, in FIG. 13(*a*), a case where any arbitrary pixel except for the video data a and t is OFF is described. In this case, when the video data b or s is the black data, PW1 becomes larger than PW2. Accordingly, when the following equation (13) is established, the comparator 23 retains the output state of the multiplexer 2, and outputs the same to the multiplexer 2 as it is.

$$PW1 \leq PW2 \tag{13}$$

In FIG. 13(*b*), when any arbitrary pixel except for the video data a and t is OFF, the above equation (12) is applicable.

As is known from the above, when the above equation (13) is satisfied, the comparator 23 does not output the control signal 12 to the multiplexer 2 so that the state for the output signal in the multiplexer 2 is retained. When the above equation (12) is satisfied, the comparator 23 outputs the control signal 12 to the multiplexer 2 so as to bring the multiplexer 2 to switch its output signal. By such operation, the present video signal processing device can always let the display display the video without a pixel shortage.

Herein, in this embodiment, similar to the case in the first embodiment, the one-clock delay circuit 1 may be any type of circuit as far as the reference signal 9 is delayed by a odd number of clocks therein. Still further, the A/D converter 3 may carry out four-phase processing or six-phase processing, resulting in the similar operation.

As is known from the above, according to the structure of the video signal processing device of this embodiment, the display can assuredly display every video signal thereon without detecting the horizontal resolution in the image signal source.

Sixth Embodiment

Figure 14:
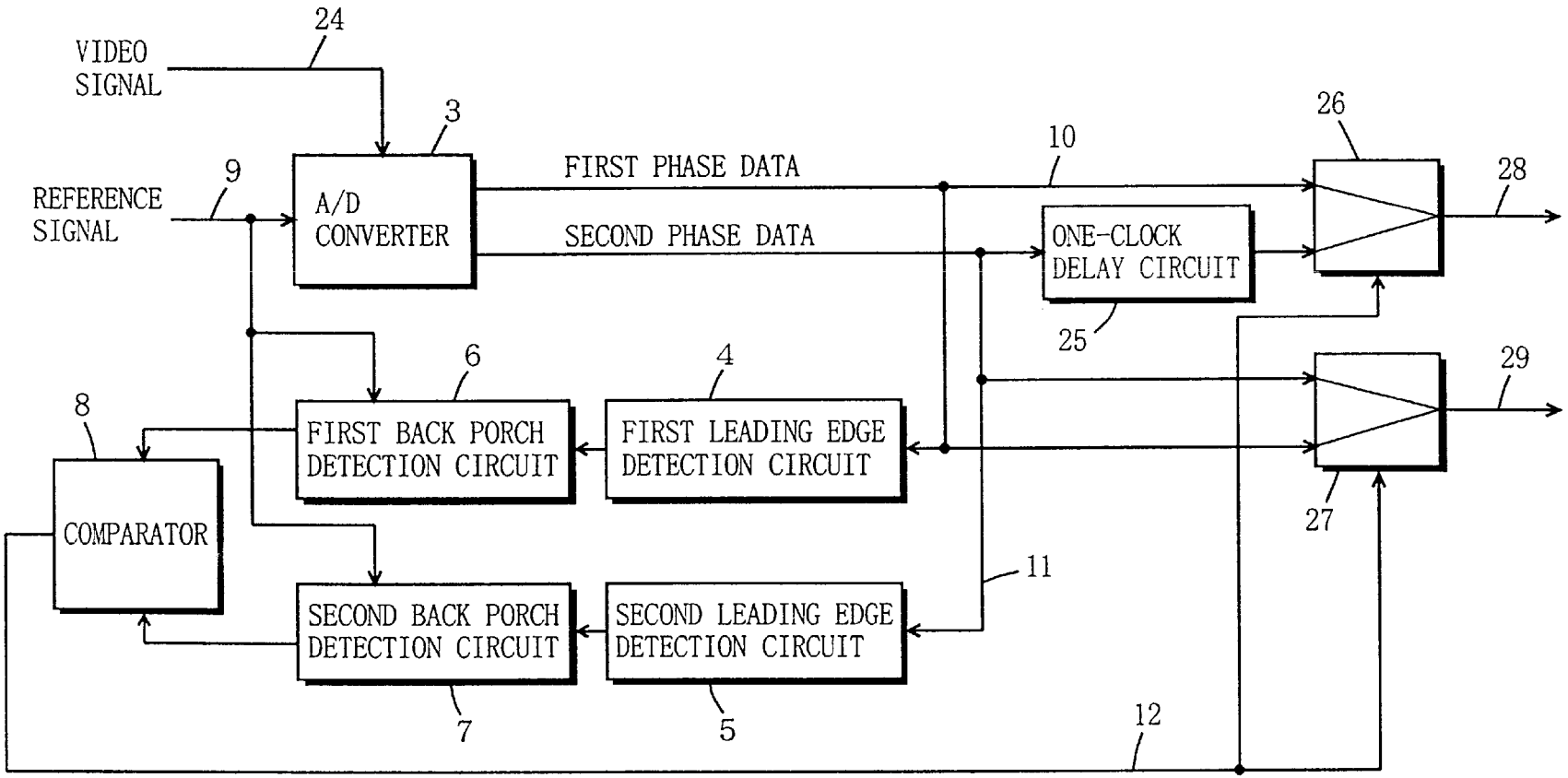
FIG. 14 is a block diagram showing the structure of a video signal processing device according to a sixth embodiment of the present invention.

FIG. 14 is a block diagram showing the structure of a video signal processing device according to a sixth embodiment of the present invention. In FIG. 14, the present video signal processing device is almost identical in structure to the above-described video signal processing device of the first embodiment in FIG. 1. The present video signal processing device is not provided with the multiplexer 2 and the one-clock. delay circuit 1, but is newly provided with multiplexers 26 and 27, and a one-clock delay circuit 25. Further, signal input/output is different therein. These are the differences from the above-described video signal processing device of the first embodiment. Thus, in the present video signal processing device, any constituent identical to that in the video signal processing device of the first embodiment is under the same reference numeral, and is not described again.

In comparison with between the video signal processing device of the above-described first or fifth embodiment, the present video signal processing device is characterized by the position of the one-clock delay circuit 25. Next below, the reason for such a characteristic is described.

In the video signal processing device of the first or the fifth embodiment, the phase of the pulse outputted from the multiplexer 2 is changed in response to the video signal 24 so that the display can assuredly display every video signal thereon. Herein, the one-clock delay circuit 1 provided in those video signal processing devices delays a signal from an image signal source only by one pixel. Accordingly, when dealing with an image signal source whose resolution is in a super high level, the one-clock delay circuit 1 needs to be structured by very high speed elements. If this is the case, problematically, the cost thereof is increased, and the consumption of electricity is also increased.

Therefore, the present video signal processing device is so structured as shown in FIG. 14 to easily address the above problems. In detail, in FIG. 14, the one-clock delay circuit 25 receives the second phase data 11, and then delays the data by one clock through the two-phase processing (that is, originally two clocks from the image signal source). Accordingly, the one-clock delay circuit 25 can deal with the image signal source having the super high resolution without being structured by the super fast elements.

Next, in the present video signal processing device, the multiplexer 26 receives the first phase data 10, and a signal outputted from the one-clock delay circuit 25 which receives the second phase data 11, that is, the one-clock delayed second phase data 11. The multiplexer 27 receives the first phase data 10 and the second phase data 11. When the present video signal processing device is activated, the multiplexer 26 selects the first phase data 10 for output, while the multiplexer 27 selects the second phase data 11 for output. Thereafter, in response to the control signal 12 outputted from the comparator 8, the multiplexer 26 switches itself to select the one-clock-delayed second phase data 11 for output, while the multiplexer 26 switches itself to select the first phase data 10 for output.

Figure 15A:
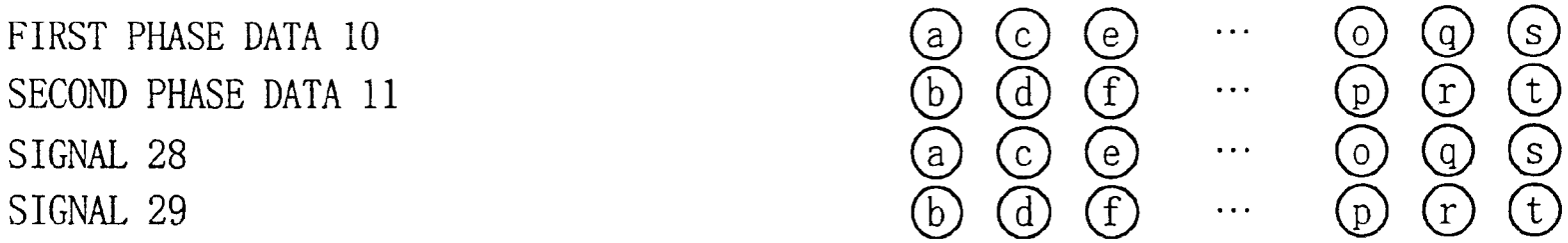
FIGS. 15(*a*) and (*b*) are diagrams for explaining the operation of the video signal processing device according to the sixth embodiment of the present invention.
Figure 15B:
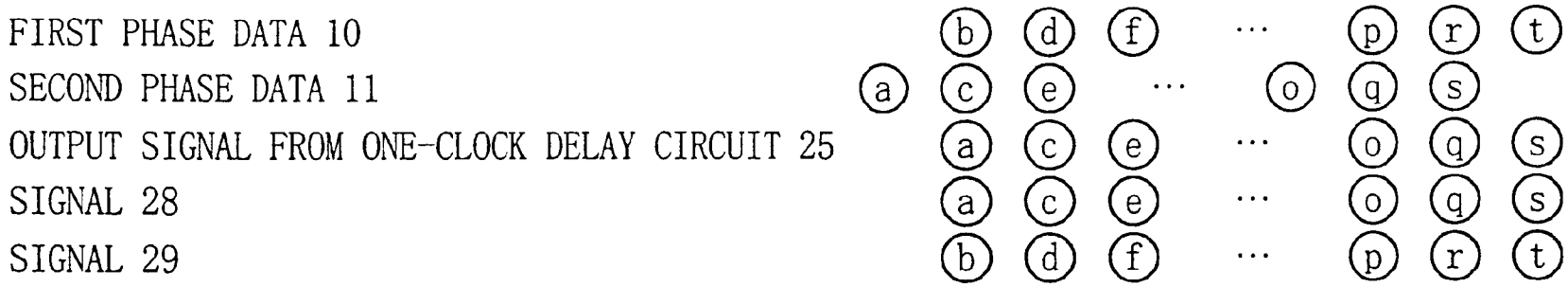

In comparison with the video signal processing device of the first embodiment, the operation of such a structured video signal processing device of this embodiment is described by referring to FIGS. 15(*a*) and (*b*).

FIGS. 15(*a*) and (*b*) are schematic diagrams showing the relationship among the first phase data 10, the second phase data 11, an output signal 28 from the multiplexer 26, and an output signal 29 from the multiplexer 27. In FIGS. 15(*a*) and (*b*), a to t denote data included in the video signal 24 going to the A/D converter 3. Specifically, FIG. 15(*a*) shows a case where the head data (data displayed on the left end on the display) in the valid video signal region is included in the first phase data 10 from the A/D converter 3, while FIG. 15(*b*) shows a case where the head data is included in the second phase data 11 from the A/D converter 11.

First, in such a case as shown in FIG. 15(*a*), the comparator 8 operates in a similar manner to the video signal processing device of the first embodiment. That is, as described in the foregoing, when the above equation (1) is satisfied, the comparator 8 does not output the control signal 12 to the multiplexers 26 and 27. Accordingly, as described in the foregoing, the multiplexers 26 and 27 select, without going through their switching operations, the first phase data 10 and the second phase data 11 outputted from the A/D converter 3, respectively, for output. In this manner, the present video signal processing device can retain the state that the head data in the valid video signal region is always outputted from the first phase data. Therefore, once retaining the state that the head data is always outputted from the first phase data, the present video signal processing circuit basically has no need to operate thereafter.

Next, similar to such a case as shown in FIG. 15(*b*), the comparator 8 operates in the same manner as the video signal processing device of the first embodiment. To be specific, as described in the foregoing, when the above equation (2) is satisfied, the comparator 8 outputs the control signal 12 to the multiplexers 26 and 27. Accordingly, in response to the control signal 12, the multiplexers 26 and 27 go through the above-described switching operation. In detail, the multiplexer 27 switches itself to select the one-clock delayed second phase data 11 for output, while the multiplexer 26 switches itself to select the first phase data 10 for output. In such manner, the present video signal processing device can retain the state that the head data in the valid video signal region is always outputted from the first phase data. Therefore, once retaining the state that the head data is always outputted from the first phase data, the present video signal processing circuit basically has no need to operate thereafter.

Note herein that, even if the head data in the valid video signal region starts to be outputted from the second phase data in operation, the present video signal processing device can retain the state that the head data in the valid video signal region is always outputted from the first phase data.

As is known from the above, the video signal processing device of this embodiment can deal with an image signal source having higher resolution, and can assuredly let the display display every video signal thereon.

Note herein that, the video signal processing device of this embodiment can be provided with first and second falling edge detection circuits instead of the first and second leading edge detection circuits 4 and 5. With such a structure, the first and second back porch detection circuits 6 and 7 operate to detect a period including the back porch period and the valid video signal period. Thus, with such a structure, the video signal processing device of this embodiment can also operate in a similar manner.

Further, for the sake of clarity, the video signal processing device of this embodiment is a modification in structure of the video signal processing device of the first embodiment. Here, the video signal processing device of this embodiment can be a modification of the video signal processing device of the above-described second or the fifth embodiment. In detail, the control signal 12 controlling the multiplexer 2 provided in the video signal processing device of the above-described second or the fifth embodiment can be used as a control signal controlling the multiplexers 26 and 27 provided in the present video signal processing device. With such a structure, the video signal processing device of this embodiment can be easily realized by modifying the video signal processing device of the second or the fifth embodiment.

Further, in this embodiment, the one-clock delay circuit 1 may be any type of circuit as far as the reference signal 9 is delayed by an odd number of clocks therein. Still further, the A/D converter 3 may carry out four-phase processing or six-phase processing, resulting in a similar operation.

Seventh Embodiment

Figure 16:
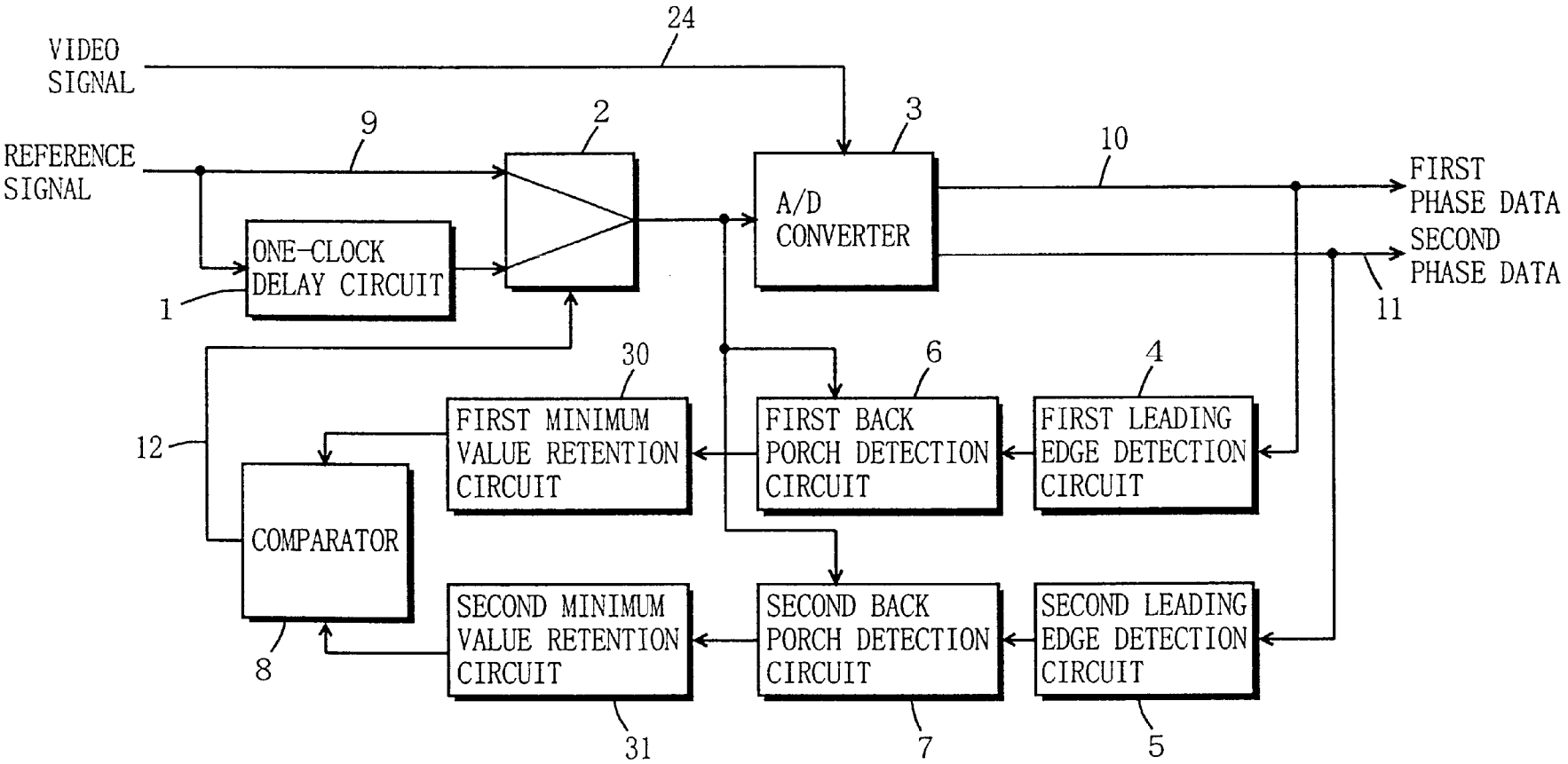
FIG. 16 is a block diagram showing the structure of a video signal processing device according to a seventh embodiment of the present invention.
Figure 17:
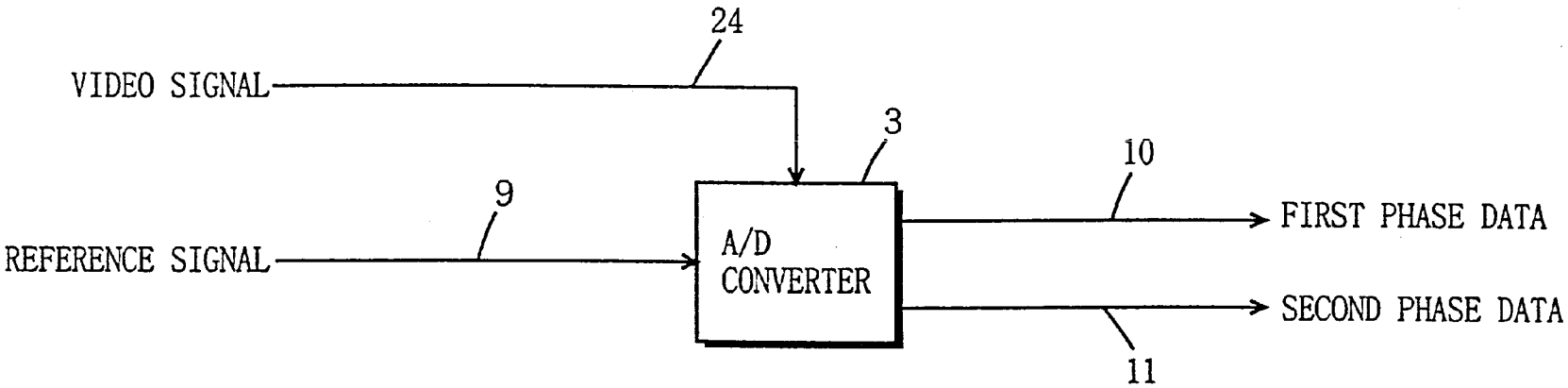
FIG. 17 PRIOR ART
FIG. 17 is a block diagram showing the structure of a conventional video signal processing device.
Figure 18:
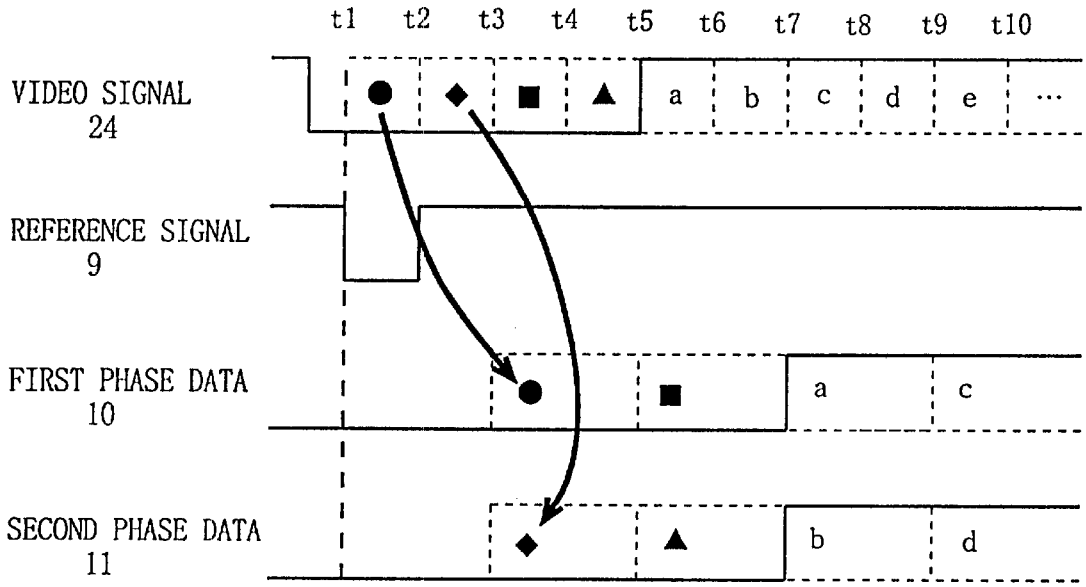
F I G. 1 8 PRIOR ART
FIG. 18 is a diagram for explaining the operation of an A/D converter which carries out two-phase processing.
Figure 19:
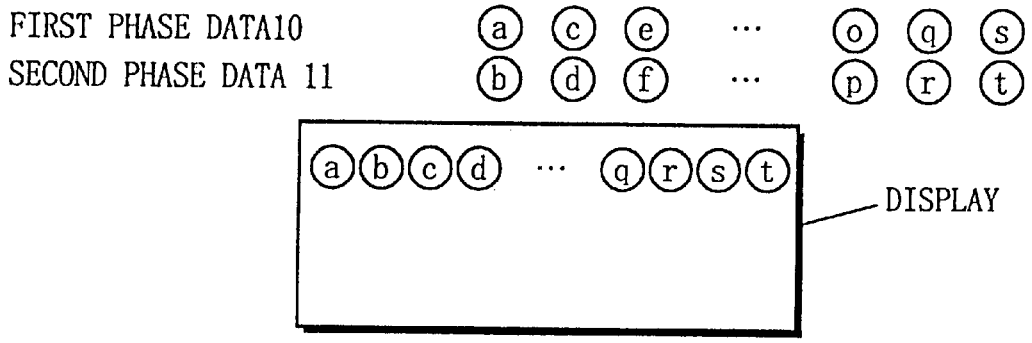
FIG. 19 PRIOR ART
FIG. 19 is a diagram for explaining the operation of the conventional video signal processing device in a case where a head of video data is outputted from the A/D converter as the first phase data.
Figure 20A:
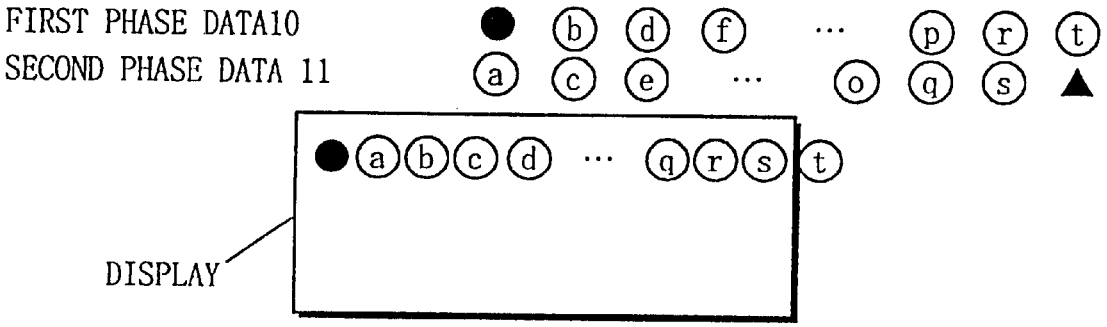
FIG. 20A PRIOR ART
FIGS. 20(*a*) and (*b*) are diagram for explaining the operation of the conventional video signal processing device in a case where the head of video data is outputted from the A/D converter as the second phase data.
Figure 20B:
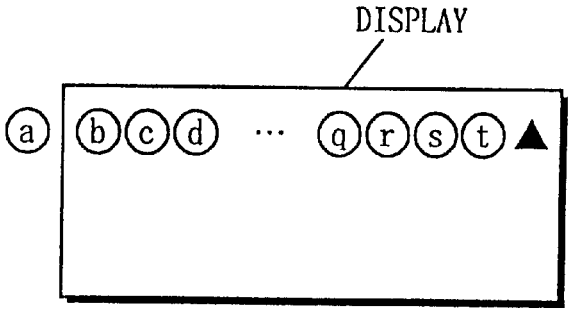
FIG. 20B PRIOR ART

FIG. 16 is a block diagram showing the structure of a video signal processing device according to a seventh embodiment of the present invention. In FIG. 16, the present video signal processing device is almost identical in structure to the above-described video signal processing device of the first embodiment in FIG. 1. The present video signal processing device is newly provided with first and second minimum value retention circuits 30 and 31, and this is the difference from the above-described video signal processing device of the first embodiment. Thus, in the present video signal processing device, any constituent identical to that in the video signal processing device of the first embodiment is under the same reference numeral, and is not described again. Next below, the reason why the first and second minimum value retention circuits 30 and 31 are newly provided is described.

The video signal processing device of the first embodiment is so structured that the back porch periods each outputted from the first and second back porch detection circuits 6 and 7 go to the comparator 8, and accordingly let the display display every video signal thereon. With such a structure, no problem occurs if any arbitrary line in the video signal 24 can be extracted for operation such as a still image. However, if the video signal 24 is a moving image, the back porch period does not stay the same. Thus, the phase of the line on the image is frequently shifted. In this respect, the video signal processing device does not operate in a normal manner.

Thus, the video signal processing device of this embodiment can easily address the above-described problem by using, as shown in FIG. 16, the first minimum value retention circuit 30 for receiving the back porch period detected by the first back porch detection circuit 6, and detecting the minimum value thereof, and the second minimum value retention circuit 31 for receiving the back porch period detected by the second back porch detection circuit 7, and detecting the minimum value thereof. Next below, the operation of the present video signal processing device is described by referring to FIG. 16.

In FIG. 16, the first and second minimum value retention circuits 30 and 31 are circuits for detecting, respectively, the minimum value of the back porch periods successively outputted from the corresponding back porch detection circuits 5 and 7. The first and second minimum value retention circuits 30 and 31 typically store the minimum value, compare the received back porch period with the minimum value in storage, and operate to update the minimum value.

Thanks to the first and second minimum value retention circuits 30 and 31, the present video signal processing device can fixedly recognize the back porch period of the video signal 24 by utilizing the minimum value thereof. In such manner, the present video signal processing device can operate in a stable manner for detection in the moving images. Further, with the first and second minimum value retention circuits 30 and 31, detection of the back porch period can be carried out in real time. Thus, the present video signal processing device can let the display display every pixel of the video signal 24 thereon regardless of the types of the video signal 24 provided from the image signal source.

As described in the foregoing, the video signal processing device of this embodiment can deal with the case, with ease, where a video signal from the image signal source is a moving image, and can assuredly let the display display every video signal thereon.

For the sake of clarity, the video signal processing device of this embodiment is provided with the first and second minimum value retention circuits 30 and 31 in addition to the video signal processing device of the first embodiment. Here, the video signal processing device of this embodiment may be provided with first and second maximum value retention circuits instead of the first and second minimum value retention circuits 30 and 31, and the first and second falling edge detection circuits instead of the first and second leading edge detection circuits 4 and 5. In such a structure, the first and second back porch detection circuits 6 and 7 operate to detect a period including both the back porch period and the valid video signal period. Thus, even with such an alternative structure, the video signal processing device of this embodiment can operate in a similar manner.

In this embodiment, similar to the cases in the above-described embodiments, the one-clock delay circuit 25 may be any type of circuit as far as the reference signal 9 is delayed by an odd number of clocks therein. Also, the A/D converter 3 may carry out four-phase processing or six-phase processing, resulting in the same operation.

INDUSTRIAL APPLICABILITY

With the present invention, a display on which pixels are fixed in number for display can display every video signal from an image signal source connected to a video signal processing device by detecting a back porch period or a valid video signal period in data varied in phase outputted from an A/D converter, and even if the image signal source is higher in resolution, the display can assuredly display every video signal by switching output data varied in phase from the A/D converter.

What is claimed is:

1. A video signal processing device for displaying, on a display, pixels in a video signal inputted from an image signal source, said video signal processing device comprising:

a clock delay circuit operable to receive a reference signal, and delay the reference signal by an odd number of clocks for output as a clock output signal;

a multiplexer operable to select either the reference signal or the clock output signal from said clock delay circuit for output as a multiplexer output signal;

an A/D converter operable to convert the video signal into a digital signal for two-phase output including first phase data and second phase data with reference to the multiplexer output signal from said multiplexer;

a first leading edge detection circuit operable to detect a leading edge of a first valid video signal region in the first phase data, and output a first detection signal corresponding thereto;

a second leading edge detection circuit operable to detect a leading edge of a second valid video signal region in the second phase data, and output a second detection signal corresponding thereto;

a first back porch detection circuit for detecting a first back porch period starting from the multiplexer output signal from said multiplexer to the first detection signal outputted from said first leading edge detection circuit;

a second back porch detection circuit for detecting a second back porch period starting from the multiplexer output signal from said multiplexer to the second detection signal outputted from said second leading edge detection circuit; and a comparator operable to compare the first back porch period and the second back porch period, and when the first back porch period is longer than the second back porch period, determine that head data in a third valid video signal region in the video signal is not included in the first phase data, and output a signal to control said multiplexer to switch the multiplexer output signal therefrom.

2. The video signal processing device according to claim 1, wherein said first back porch detection circuit detects the first back porch period by using a number of clocks in the video signal, and said second back porch detection circuit detects the second back porch period by using the number of clocks in the video signal.

3. The video signal processing device according to claim 1, further comprising a first minimum value retention circuit operable to input, into said comparator, a minimum value of a number of first back porch periods outputted from said first back porch detection circuit as another first back porch period, and a second minimum value retention circuit operable to input, into said comparator, a minimum value of a number of second back porch periods outputted from said second back porch detection circuit as another second back porch period.

4. A video signal processing device for displaying, on a display, pixels in a video signal inputted from an image signal source, said video signal processing device comprising:

a clock delay circuit operable to receive a reference signal, and delay the reference signal by the an odd number of clocks for output as a clock output signal;

a multiplexer operable to select either the reference signal or the clock output signal from said clock delay circuit for output as a multiplexer output signal;

an A/D converter operable to convert the video signal into a digital signal for two-phase output including first phase data and second phase data with reference to the multiplexer output signal from said multiplexer;

a leading edge detection circuit operable to detect, in a predetermined manner, a leading edge of a first valid video signal region in either the first phase data or the second phase data, and outputs a detection signal corresponding thereto;

a back porch detection circuit operable to detect a back porch period starting from the multiplexer output signal from said multiplexer to the detection signal outputted from said leading edge detection circuit;

a storage part operable to receive the back porch period, and store and output the back porch period in a separate manner depending on whether the back porch period is based on the reference signal or the clock output signal selected and outputted by said multiplexer as the multiplexer output signal; and a comparator operable to output a control signal to control said multiplexer to switch the multiplexer output signal selected and outputted therefrom so that said storage part outputs a back porch period corresponding to each of the reference signal and the clock output signal as the multiplexer output signal selected and outputted from said multiplexer, compare the corresponding back porch periods outputted from said storage part with each other, and when the back porch period corresponding to the reference signal as the multiplexer output signal is equal to or shorter than the back porch period corresponding to the clock output signal from said clock delay circuit as the multiplexer output signal, determine that head data in a second valid video signal region in the video signal is included in the first phase data, and output another control signal.

5. The video signal processing device according to claim 4, wherein said back porch detection circuit detects the back porch period by using a number of clocks in the video signal.

6. A video signal processing device for displaying, on a display, pixels in a video signal inputted from an image signal source, said video signal processing device comprising:

a clock delay circuit operable to receive a reference signal, and delay the reference signal by an odd number of clocks for output as a clock output signal;

a multiplexer operable to select either the reference signal or the clock output signal from said clock delay circuit for output as a multiplexer output signal;

an A/D converter operable to convert the video signal into a digital signal for two-phase output including first phase data and second phase data with reference to the multiplexer output signal from said multiplexer;

a leading edge detection circuit operable to detect a leading edge of a first valid video signal region in the first phase data, and outputs a first detection signal corresponding thereto;

a falling edge detection circuit operable to detect a falling edge of a second valid video signal region in the second phase data, and output a second detection signal corresponding thereto;

a valid video period detection circuit operable to detect a valid video period starting from the first detection signal outputted from said leading edge detection circuit to the second detection signal outputted from said falling edge detection circuit; and a comparator operable to compare a value half of an inputted horizontal resolution with the valid video period, and when the value half of the horizontal resolution is larger than the valid video period in value, determine that head data in a third valid video signal region in the video signal is not included in the first phase data, and output a signal to control said multiplexer to switch the multiplexer output signal therefrom.

7. The video signal processing device according to claim 6, wherein said valid video period detection circuit detects the valid video period by using a number of clocks in the video signal.

8. A video signal processing device for displaying, on a display, pixels in a video signal inputted from an image signal source, said video signal processing device comprising:

a clock delay circuit operable to receive a reference signal, and delay the reference signal by an odd number of clocks for output as a clock output signal;

a multiplexer operable to select either the reference signal or the clock output signal from said clock delay circuit for output as a multiplexer output signal;

an A/D converter operable to convert the said video signal into a digital signal for two-phase output including first phase data and second phase data with reference to the multiplexer output signal from said multiplexer;

a leading edge detection circuit operable to detect a leading edge of a second valid video signal region in the second phase data, and outputs a second detection signal corresponding thereto;

a falling edge detection circuit operable to detect a falling edge of a first valid video signal region in the first phase data, and outputs a first detection signal corresponding thereto;

a valid video period detection circuit operable to detect a valid video period starting from the second detection signal outputted from said leading edge detection circuit to the first detection signal outputted from said falling edge detection circuit; and a comparator operable to compare a value half of an inputted horizontal resolution with the valid video period, and when the value half of the horizontal resolution is smaller than the valid video period in value, determine that head data in a third valid video signal region in the video signal is not included in the first phase data, and output a signal to control said multiplexer to switch the multiplexer output signal therefrom.

9. The video signal processing device according to claim 8, wherein said valid video period detection circuit detects the valid video period by using a number of clocks in the video signal.

10. A video signal processing device for displaying, on a display, pixels in a video signal inputted from an image signal source, said video signal processing device comprising:

a clock delay circuit operable to receive a reference signal, and delay the reference signal by an odd number of clocks for output as a clock output signal;

a multiplexer operable to select either the reference signal or the clock output signal from said clock delay circuit for output as a multiplexer output signal;

an A/D converter operable to convert the video signal into a digital signal for two-phase output including first phase data and second phase data with reference to the multiplexer output signal from said multiplexer;

a first leading edge detection circuit operable to detect a leading edge of a first valid video signal region in the first phase data, and output a first leading edge detection signal corresponding thereto;

a second leading edge detection circuit operable to detect a leading edge of a second valid video signal region in the second phase data, and output a second leading edge detection signal corresponding thereto;

a first falling edge detection circuit operable to detect a falling edge of the second valid video signal region in the second phase data, and output a first falling edge detection signal corresponding thereto;

a second falling edge detection circuit operable to detect a falling edge of the first valid video signal region in the first phase data, and output a second falling edge detection signal corresponding thereto;

a first valid video period detection circuit operable to detect a first valid video period starting from the first leading edge detection signal outputted from said first leading edge detection circuit to the first falling edge detection signal outputted from said first falling edge detection circuit;

a second valid video period detection circuit operable to detect a second valid video period starting from the second leading edge detection signal outputted from said second leading edge detection circuit to the second falling edge detection signal outputted from said second falling edge detection circuit; and a comparator operable to compare the first valid video period and the second valid video period, and when the second valid video period is longer than the first valid video period, determine that head data in a third valid video signal region in the video signal is not included in the first phase data, and output a signal to control said multiplexer to switch the multiplexer output signal therefrom.

11. The video signal processing device according to claim 10, wherein said first valid video period detection circuit detects the first valid video period by using a number of clocks in said video signal, and said second valid video period detection circuit detects the second valid video period by using the number of clocks in the video signal.

12. A video signal processing device for displaying, on a display, pixels in a video signal inputted from an image signal source, said video signal processing device comprising:

an A/D converter operable to convert the video signal into a digital signal for two-phase output including first phase data and second phase data with reference to an incoming reference signal;

a clock delay circuit to receive the second phase data, and delay the second phase data by an odd number of clocks for output as a clock output signal;

a first multiplexer operable to select either the first phase data or the clock output signal from said clock delay circuit for output as a first multiplexer output signal;

a second multiplexer operable to select either the second phase data or the first phase data for output as a second multiplexer output signal;

a first leading edge detection circuit operable to detect a leading edge of a first valid video signal region in the first phase data, and outputs a first detection signal corresponding thereto;

a second leading edge detection circuit operable to detect a leading edge of a second valid video signal region in the second phase data, and output a second detection signal corresponding thereto;

a first back porch detection circuit operable to detect a first back porch period starting from the reference signal to the first detection signal outputted from said first leading edge detection circuit;

a second back porch detection circuit operable to detect a second back porch period starting from the reference signal to the second detection signal outputted from said second leading edge detection circuit; and a comparator operable to compare the first back porch period and the second back porch period, and when the first back porch period is longer than the second back porch period, determine that head data in a third valid video signal region in the video signal is not included in the first phase data, and output a signal to control said first and second multiplexers to switch the first multiplexer output signal and second multiplexer output signal simultaneously, wherein right after activation of said video signal processing device, said first multiplexer selects the first phase data for output as the first multiplexer output signal, and said second multiplexer selects the second phase data for output as the second multiplexer output signal.

13. The video signal processing device according to claim 12, wherein said first back porch detection circuit detects the first back porch period by using a number of clocks in the video signal, and said second back porch detection circuit detects the second back porch period by using the number of clocks in the video signal.

* * * * *